US008437995B2

(12) United States Patent
Matthews et al.

(10) Patent No.: US 8,437,995 B2
(45) **Date of Patent: *May 7, 2013**

(54) DRILL BIT AND DESIGN METHOD FOR OPTIMIZING DISTRIBUTION OF INDIVIDUAL CUTTER FORCES, TORQUE, WORK, OR POWER

(75) Inventors: Oliver Matthews, Houston, TX (US); Robert I. Clayton, Deer Park, TX (US); Shilin Chen, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 428 days.

This patent is subject to a terminal disclaimer.

(21) Appl. No.: 12/167,350

(22) Filed: Jul. 3, 2008

(65) Prior Publication Data

US 2009/0166091 A1 Jul. 2, 2009

Related U.S. Application Data

(63) Continuation of application No. 10/236,346, filed on Sep. 6, 2002, now abandoned, which is a continuation-in-part of application No. 10/189,305, filed on Jul. 2, 2002, now abandoned, which is a continuation of application No. 09/629,344, filed on Aug. 1, 2000, now Pat. No. 6,412,577, which is a continuation of application No. 09/387,304, filed on Aug. 31, 1999, now Pat. No. 6,095,262, said application No. 10/236,346 is a continuation-in-part of application No. 09/833,016, filed on Apr. 10, 2001, now abandoned, which is a continuation of application No. 09/387,737, filed on Aug. 31, 1999, now Pat. No. 6,213,225.

(60) Provisional application No. 60/098,442, filed on Aug. 31, 1998, provisional application No. 60/098,466, filed on Aug. 31, 1998.

(51) Int. Cl.
*G06G 7/48* (2006.01)

(52) U.S. Cl.
USPC ..... 703/7

(58) Field of Classification Search ..... 703/7
See application file for complete search history.

(56) References Cited

U.S. PATENT DOCUMENTS 1,209,299 A 12/1916 Hughes (Continued)

FOREIGN PATENT DOCUMENTS

CN 20827550 8/1991

OTHER PUBLICATIONS

Decision from EPO revoking European Patent No. EP-B-1117894, pp. 16, May 15, 2006.

(Continued)

*Primary Examiner* — Hugh Jones
(74) *Attorney, Agent, or Firm* — Baker Botts L.L.P.

(57) ABSTRACT

A design process and resulting bit structure is provided for drill bits wherein cutter geometries on the face of the bit are tailored to optimize the distribution of one or more of forces, torque, work, or power of each cutter relative to other cutters. Balanced are the forces, torque, work, or power generated by each cutter in respect to other cutters that are working within the same region of cut, so that all cutters within the same region of cut are generating sufficiently comparable forces, torque, work, or power. In this manner all of the cutters on the bit may share as closely as possible the work and loads required to penetrate the subterranean rock. The design process produces a bit structure in which each cutter is doing similar levels of work or creating similar levels of force, torque, or power relative to other cutters within the same region of cut on the bit, within specified ranges of design criteria.

19 Claims, 35 Drawing Sheets

U.S. PATENT DOCUMENTS

| | | | | | |
|---|---|---|---|---|---|
| 1,263,802 | A | | 4/1918 | Reed | |
| 1,394,769 | A | | 10/1921 | Sorensen | |
| 3,106,973 | A | | 10/1963 | Christensen | |
| 3,163,246 | A | | 12/1964 | Vagins et al. | |
| 4,475,606 | A | * | 10/1984 | Crow | 175/431 |
| 4,627,276 | A | | 12/1986 | Burgess et al. | 73/151 |
| 4,815,342 | A | | 3/1989 | Brett et al. | 76/108 |
| 5,197,555 | A | | 3/1993 | Estes | 175/431 |
| 5,216,917 | A | | 6/1993 | Detournay | 73/374 |
| 5,305,836 | A | | 4/1994 | Holbrook et al. | 175/39 |
| 5,372,210 | A | | 12/1994 | Harrell | 175/431 |
| 5,415,030 | A | | 5/1995 | Jogi et al. | 73/151 |
| 5,595,252 | A | * | 1/1997 | O'Hanlon | 175/57 |
| 5,730,234 | A | | 3/1998 | Putot | 175/50 |
| 5,794,720 | A | | 8/1998 | Smith et al. | 175/40 |
| 6,021,377 | A | | 2/2000 | Dubinsky et al. | 702/9 |
| 6,095,262 | A | | 8/2000 | Chen | 175/57 |
| 6,213,225 | B1 | | 4/2001 | Chen | 175/57 |
| 6,527,068 | B1 | | 3/2003 | Singh et al. | 175/431 |

OTHER PUBLICATIONS

D. Ma, "The Operational Mechanics of the Rock Bit", Petroleum Industry Press, Beijing, China, pp. 244, 1996.

D. Ma, D. Zhou & R. Deng, "The Computer Stimulation of the Interaction Between Roller Bit and Rock", 1995.

D. Ma, & J.J. Azar, "Dynamics of Roller Cone Bits", Dec. 1985.

D. Ma; J.J. Azar: "A New Way to Characterize the Gouge-Scraping Action of Roller Cone Bits" SPE #19448, 1989, pp. 1-21, XP 002258936, 1989.

Ma D et al: "A New Method for Designing Rock Bit" SPE Proceedings, XX, XX, vol. 22431, Mar. 24, 1992, XP008058830, Mar. 24, 1991.

Ma D K et al: "Kinematics of the Cone Bit" Society of Petroleum Engineers Journal, Dallas, TX US, No. 10563, Jun. 1, 1985, pp. 321-329, 716, XP002367444 ISSN: 0197-7520.

Examination Report; Communication Pursuant to Article 94(3) EPC issued by the EPO; Application No. 03 021 139.5-2315; Ref. 100 353 a/jme, Mar. 3, 2010.

* cited by examiner

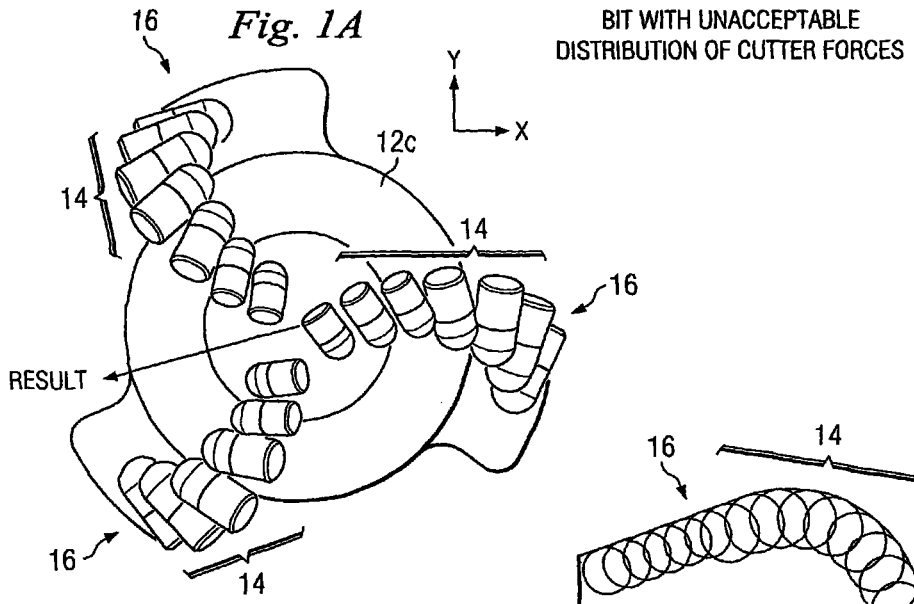
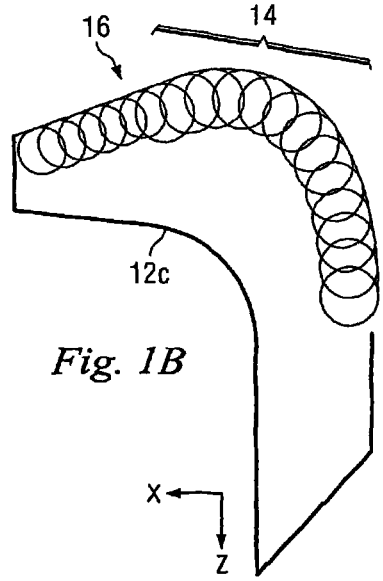
Fig. 1B
Fig. 1D
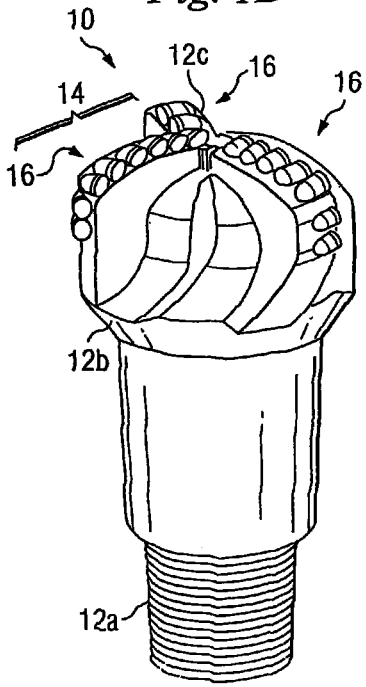
Fig. 1C
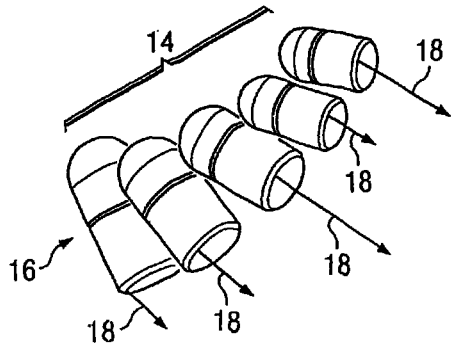

BIT WITH OPTIMIZED
DISTRIBUTION OF CUTTER FORCES

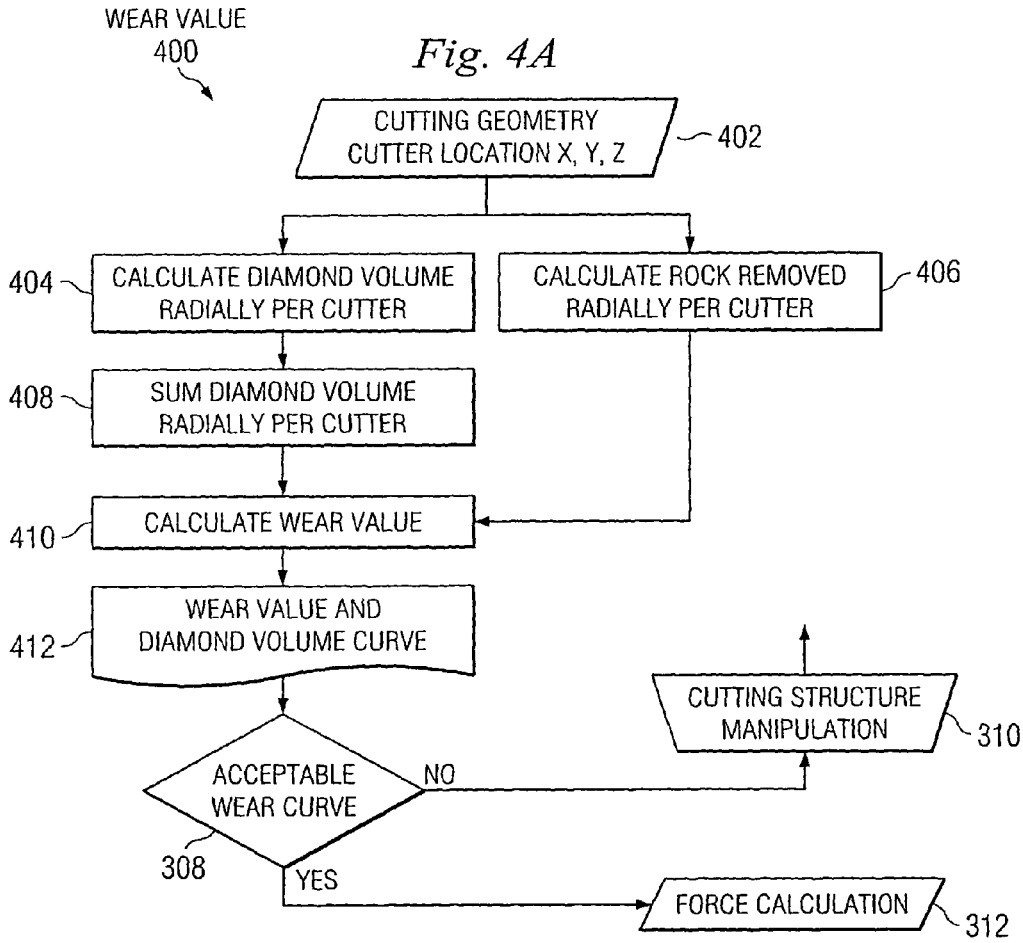
WEAR VALUE
400
Fig. 4A
CUTTING GEOMETRY
CUTTER LOCATION X, Y, Z
402
404
CALCULATE DIAMOND VOLUME
RADIALLY PER CUTTER
CALCULATE ROCK REMOVED
RADIALLY PER CUTTER
406
408
SUM DIAMOND VOLUME
RADIALLY PER CUTTER
410
CALCULATE WEAR VALUE
412
WEAR VALUE AND
DIAMOND VOLUME CURVE
CUTTING STRUCTURE
MANIPULATION
310
ACCEPTABLE
WEAR CURVE
NO
308
YES
FORCE CALCULATION
312

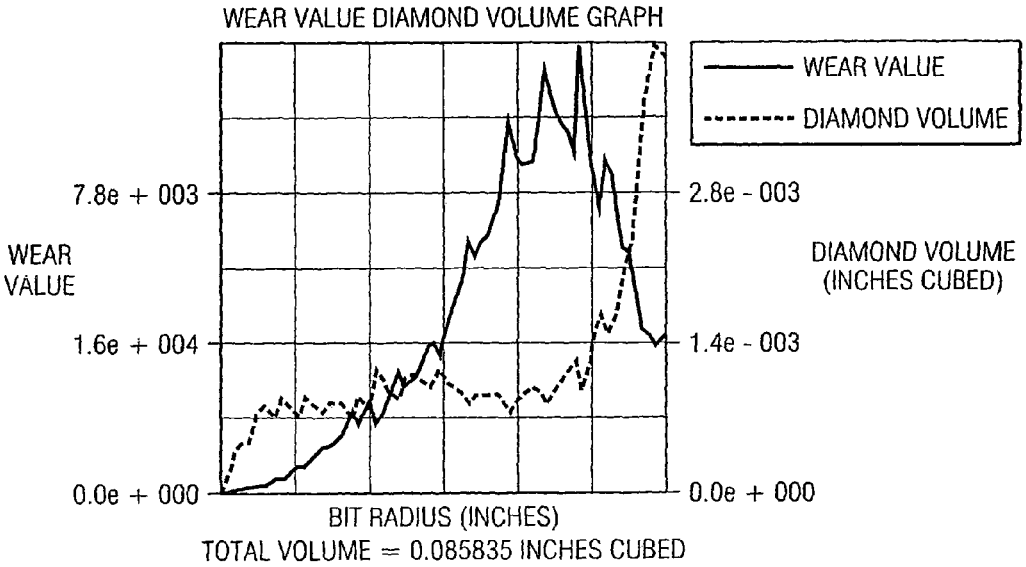
Fig. 4B
WEAR VALUE DIAMOND VOLUME GRAPH
WEAR VALUE
DIAMOND VOLUME
7.8e + 003
1.6e + 004
0.0e + 000
WEAR
VALUE
2.8e - 003
1.4e - 003
0.0e + 000
DIAMOND VOLUME
(INCHES CUBED)
BIT RADIUS (INCHES)
TOTAL VOLUME = 0.085835 INCHES CUBED

EXAMPLE OF EVALUATION OF TOTAL VARIANCE IN TORQUE

EXAMPLE OF TOTAL VARIANCE IN AVERAGE DELTA TORQUE

EXAMPLE OF TOTAL VARIANCE IN DELTA TORQUE

EXAMPLE OF EVALUATION OF TORQUE

EXAMPLE OF EVALUATION OF TORQUE

EXAMPLE OF EVALUATION OF TORQUE

EXAMPLE OF TOTAL VARIANCE IN AVERAGE DELTA TORQUE

EXAMPLE OF EVALUATION OF TORQUE

EXAMPLE OF EVALUATION OF TORQUE

EXAMPLE OF TOTAL VARIANCE IN AVERAGE DELTA TORQUE

ORIGINAL DELTA DRAG DISTRIBUTION

ORIGINAL DELTA TORQUE FORCE DISTRIBUTION

LAYOUT AFTER CUTTER SPACING CHANGE
(MODIFIED DESIGN #1)

ACCEPTABLE WEAR VALUE AFTER CUTTER
SPACING CHANGE (MODIFIED DESIGN #1)

*Fig. 8C*

NEW FORCE BALANCE IS CHECKED (MODIFIED DESIGN #1)

INFORMATION

File Edit

PARAMETER INPUTS: _> AXIAL AREA/SECURITYDBS

| ROP | RPM | ROCK STRENGTH | HOURS OF DRILL |
|---|---|---|---|
| 30.000 | 120.0000 | 18000.0000 | 0.2500 |

ANALYSIS RESULTS:

BIT IMBALANCE——

| | | |
|---|---|---|
| RESULT: | 358.9833 deg. | 5.5642 % 873.9998 lbs |
| RADIAL: | 2.3298 deg. | 3.2646 % 512.7842 lbs |
| DRAG: | 354.2575 deg. | 2.3131 % 363.3252 lbs |
| MOMENT: | 254.7620 deg. | 5.2889 % 109.1530 ft-lbs |

| | |
|---|---|
| WOB | 15707.6194 lbs |
| LATERAL FORCE (x) | 873.8622 lbs |
| LATERAL FORCE (y) | -15.5082 lbs |
| TOB | 2063.7976 ft-lbs |
| LATERAL MOMENT (x) | -28.6887 ft-lbs |
| LATERAL MOMENT (y) | -105.3154 ft-lbs |

BIT ENGAGEMENT AREAS——

| | |
|---|---|
| AXIAL AREA | 0.1948 in. sq. |
| RADIAL AREA | 0.0047 in. sq. |
| DRAG AREA | 0.2095 in. sq. |
| WEAR FLAT AREA | 0.0000 in. sq. |

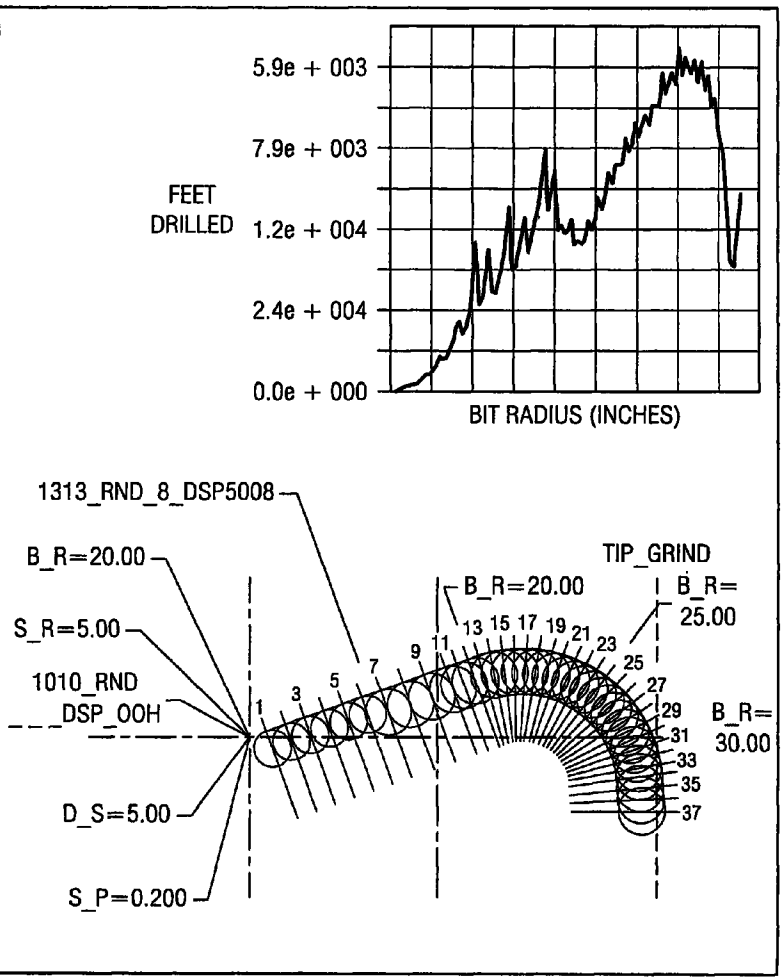

CUTTERS #2 & #3 ARE MOVED
(MODIFIED DESIGN #2)

*Fig. 9B*

NEW FORCE BALANCE IS CHECKED (MODIFIED DESIGN #2)

INFORMATION

File Edit

PARAMETER INPUTS: _> AXIAL AREA/SECURITYDBS

| ROP | RPM | ROCK STRENGTH | HOURS OF DRILL |
|---|---|---|---|
| 30.000 | 120.0000 | 18000.0000 | 0.2500 |

ANALYSIS RESULTS:

BIT IMBALANCE----

| | | |
|---|---|---|
| RESULT: | 4.0102 deg. | 5.3163 % 836.4398 lbs |
| RADIAL: | 359.9065 deg. | 3.0148 % 474.3387 lbs |
| DRAG: | 9.3478 deg. | 2.3192 % 364.8994 lbs |
| MOMENT: | 255.5673 deg. | 5.3472 % 110.3636 ft-lbs |

| | |
|---|---|
| WOB | 15733.6054 lbs |
| LATERAL FORCE (x) | 834.3918 lbs |
| LATERAL FORCE (y) | 58.4961 lbs |
| TOB | 2063.9568 ft-lbs |
| LATERAL MOMENT (x) | -27.5074 ft-lbs |
| LATERAL MOMENT (y) | -106.8806 ft-lbs |

BIT ENGAGEMENT AREAS----

| | |
|---|---|
| AXIAL AREA | 0.1951 in. sq. |
| RADIAL AREA | 0.0046 in. sq. |
| DRAG AREA | 0.2095 in. sq. |
| WEAR FLAT AREA | 0.0000 in. sq. |

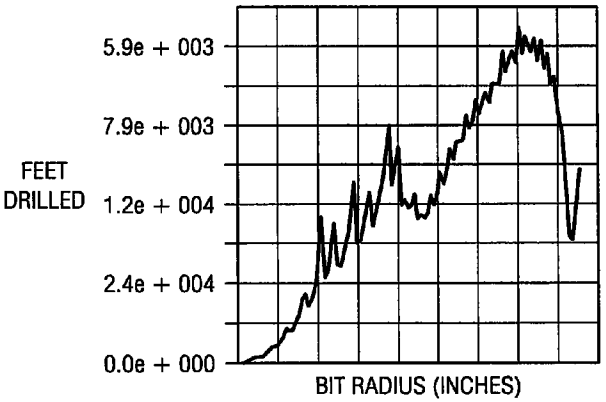

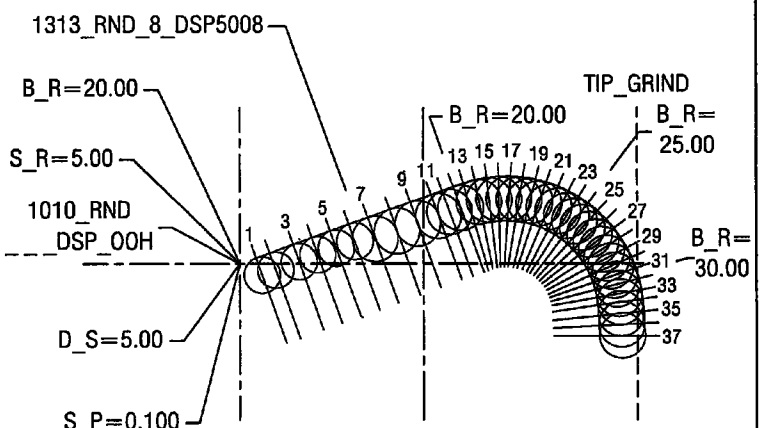

*Fig. 10B*

NEW FORCE BALANCE IS CHECKED (MODIFIED DESIGN #3)

INFORMATION

File Edit

PARAMETER INPUTS: _> AXIAL AREA/SECURITYDBS

| ROP | RPM | ROCK STRENGTH | HOURS OF DRILL |
|---|---|---|---|
| 30.000 | 120.0000 | 18000.0000 | 0.2500 |

ANALYSIS RESULTS:

BIT IMBALANCE----

| | | |
|---|---|---|
| RESULT: | 356.5285 deg. | 3.9877 % 627.4113 lbs |
| RADIAL: | 4.1411 deg. | 2.4978 % 392.9880 lbs |
| DRAG: | 344.1842 deg. | 1.5477 % 243.5169 lbs |
| MOMENT: | 283.8824 deg. | 3.1053 % 64.0998 ft-lbs |

| | |
|---|---|
| WOB | 15733.6681 lbs |
| LATERAL FORCE (x) | 626.2601 lbs |
| LATERAL FORCE (y) | -37.9908 lbs |
| TOB | 2064.2389 ft-lbs |
| LATERAL MOMENT (x) | 15.3795 ft-lbs |
| LATERAL MOMENT (y) | -62.2275 ft-lbs |

BIT ENGAGEMENT AREAS----

| | |
|---|---|
| AXIAL AREA | 0.1951 in. sq. |
| RADIAL AREA | 0.0037 in. sq. |
| DRAG AREA | 0.2095 in. sq. |
| WEAR FLAT AREA | 0.0000 in. sq. |

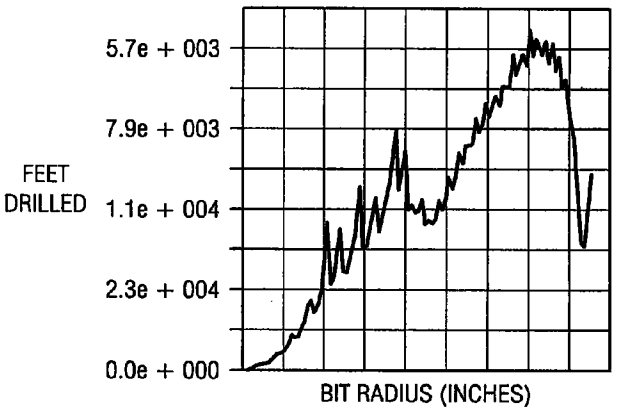

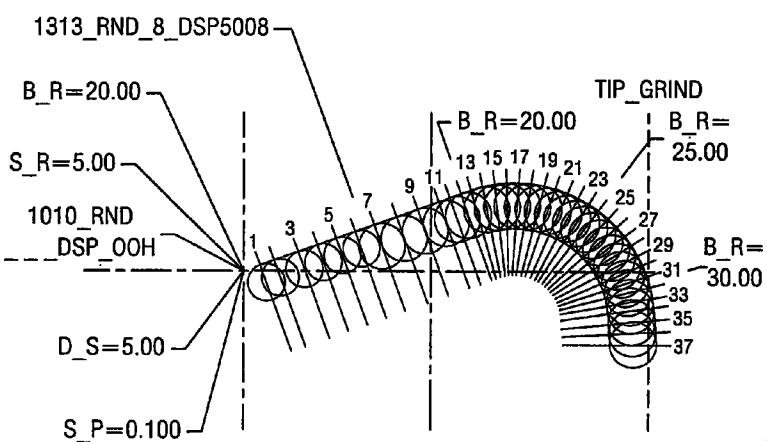

NEW TORQUE DISTRIBUTION
(MODIFIED DESIGN #4)

NEW DRAG FORCE DISTRIBUTION
(MODIFIED DESIGN #4)

NEW DELTA TORQUE DISTRIBUTION
(MODIFIED DESIGN #4)

ENERGY BALANCE: 5.4%
AVERAGE DELTA TRQ: 3.7
AVERAGE TRQ: 68.5

NEW DELTA DRAG
FORCE DISTRIBUTION
(MODIFIED DESIGN #4)

ENERGY BALANCE: 3.4%
AVERAGE DELTA DRG: 12.0
AVERAGE DRG: 351.2

ACCEPTABLE ENERGY BALANCE CUTTER PROFILE (MODIFIED DESIGN #4)

ACCEPTABLE NEW FORCE & MOMENT BALANCE (MODIFIED DESIGN #5)

*Fig. 13B*

FINAL FORCE & MOMENT BALANCE (MODIFIED DESIGN #6)

INFORMATION

File Edit

PARAMETER INPUTS: _> AXIAL AREA/SECURITYDBS

| ROP | RPM | ROCK STRENGTH | HOURS OF DRILL |
|---|---|---|---|
| 30.000 | 120.0000 | 18000.0000 | 0.2500 |

ANALYSIS RESULTS:

| BIT IMBALANCE---- | | |
|---|---|---|
| RESULT: | 351.4202 deg. | 3.5654 % 560.0982 lbs |
| RADIAL: | 2.4184 deg. | 2.2172 % 348.3079 lbs |
| DRAG: | 334.4820 deg. | 1.4519 % 228.0818 lbs |
| MOMENT: | 296.0235 deg. | 2.2787 % 46.9426 ft-lbs |

| | |
|---|---|
| WOB | 15709.0863 lbs |
| LATERAL FORCE (x) | 553.8302 lbs |
| LATERAL FORCE (y) | -83.5591 lbs |
| TOB | 2060.0633 ft-lbs |
| LATERAL MOMENT (x) | 20.5955 ft-lbs |
| LATERAL MOMENT (y) | -42.1833 ft-lbs |

| BIT ENGAGEMENT AREAS---- | |
|---|---|
| AXIAL AREA | 0.1947 in. sq. |
| RADIAL AREA | 0.0033 in. sq. |
| DRAG AREA | 0.2095 in. sq. |
| WEAR FLAT AREA | 0.0000 in. sq. |

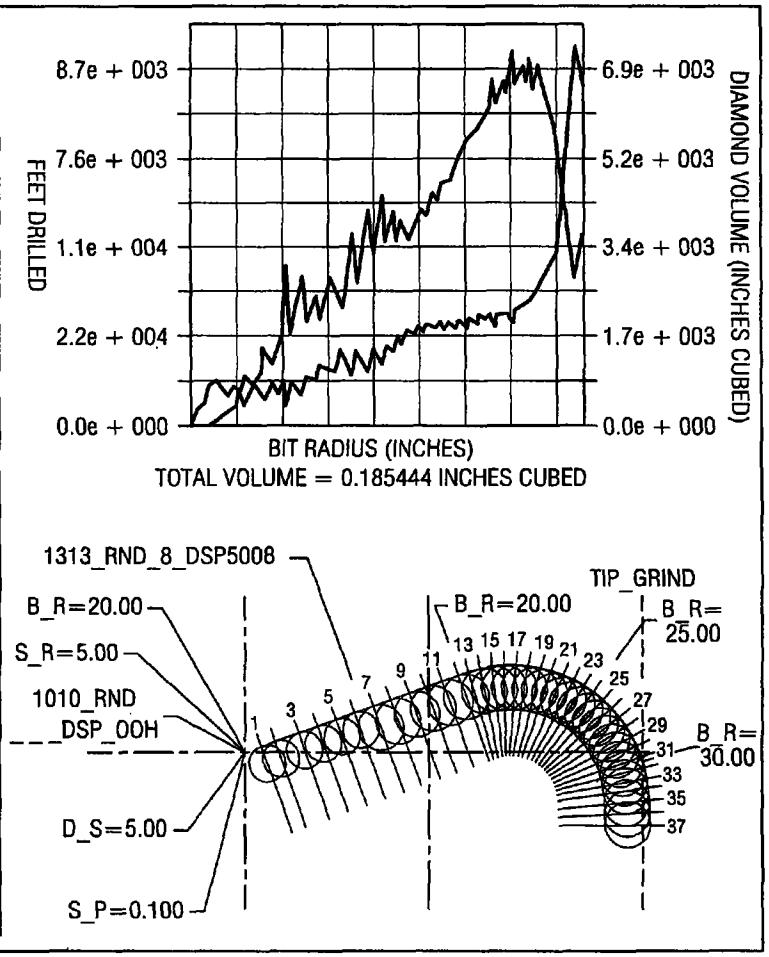

FINAL TORQUE DISTRIBUTION
(MODIFIED DESIGN #6)

FINAL DRAG FORCE DISTRIBUTION
(MODIFIED DESIGN #6)

FINAL DELTA TORQUE DISTRIBUTION (MODIFIED DESIGN #6)

FINAL DELTA DRAG FORCE DISTRIBUTION (MODIFIED DESIGN #6)

1500

1500

DRILL BIT AND DESIGN METHOD FOR OPTIMIZING DISTRIBUTION OF INDIVIDUAL CUTTER FORCES, TORQUE, WORK, OR POWER

CROSS REFERENCE TO RELATED APPLICATIONS

This application is a continuation of U.S. patent application Ser. No. 10/236,346 filed on Sep. 6, 2002, which is a continuation-in-part of U.S. patent application Ser. No. 10/189,305 filed on Jul. 2, 2002, which is a continuation of U.S. patent application Ser. No. 09/629,344 filed on Aug. 1, 2000, now U.S. Pat. No. 6,412,577, which is a continuation of U.S. patent application Ser. No. 09/387,304 filed on Aug. 31, 1999, now U.S. Pat. No. 6,095,262, which claims the benefit of U.S. Provisional Application Ser. No. 60/098,442 filed on Aug. 31, 1998, which are hereby incorporated by reference.

U.S. patent application Ser. No. 10/236,346 filed on Sep. 6, 2002 is also a continuation-in-part of U.S. patent application Ser. No. 09/833,016 filed on Apr. 10, 2001, which is a continuation of U.S. patent application Ser. No. 09/387,737 filed on Aug. 31, 1999, now U.S. Pat. No. 6,213,225, which claims the benefit of U.S. Provisional Application Ser. No. 60/098,466 filed on Aug. 31, 1998, which are hereby incorporated by reference.

TECHNICAL FIELD

The present disclosure relates generally to rotary bits for drilling subterranean formations and, more specifically, to drill bits and methods of their design wherein cutter geometries are varied at different locations on the face of the bit.

BACKGROUND

Subterranean drilling involves the use of two main types of drill bits, one being a roller cone bit and the other being a fixed cutter or so-called "drag" bit. A roller cone bit has a set of cones having teeth or cutting inserts arranged on rugged bearings on the arms of the bit. As the drill string is rotated, the cones will roll on the bottom of the hole, and the teeth or cutting inserts will crush the formation beneath them. Fixed cutter or "drag" bits employ fixed superabrasive cutters (usually comprising polycrystalline diamond compacts, or "PDCs") which crush or shear the formation as the drill string is rotated.

For both roller cone and fixed cutter bits, the economics of drilling a well are strongly reliant on the rate of penetration. Since the design of the cutting structure of a drill bit controls the bit's ability to achieve a high rate of penetration, cutting structure design plays a significant role in the overall economics of drilling a well.

Accordingly, drill bits are the subject of competitive design methodologies that seek to create a bit structure with superior performance for the particular drilling application. In general, design goals include the creation of a bit with a cutting action that is resistant to slip-stick incidents, resistant to bit whirl, and that reduces the destructive impact loads on the bit caused by down hole vibrations, thereby achieving a higher overall rate of penetration (ROP) and reduced cutter wear. To these ends, iterative design approaches are utilized to establish and test cutting structure geometries prior to manufacturing of the bit.

In one aspect, force balancing of bits is utilized to improve stabilization and bit performance. For example, each cutter exerts forces on the formation as the bit rotates and penetrates.

The magnitude and direction of these forces is dependent upon cutter location, cutter engagement, back rake, and side rake. Kinematic models derived from laboratory testing are able to estimate these forces for given operating conditions and formation characteristics. Bit balance (or imbalance) can be investigated through summations of linear and moment force vectors. Adjustments to the cutter placement and orientation across the bit face may then be made to reduce the imbalance numbers in a way that results in a low summation of the lateral forces generated by each cutter. This balancing technique dramatically reduces down hole vibrations that may be caused by the bit's cutting action.

However, analysis and control of the summation of the lateral forces generated by each cutter does not consider how the individual forces generated by each cutter compare to each other. Adjacent cutters or cutters within the same region of cut may be doing substantially different levels of work and may be generating significantly different levels of forces. This can cause different rates of wear from cutter to cutter. Furthermore, where some cutters on the bit are creating significantly higher levels of force than others, significant and deleterious instantaneous force imbalances may be created as formation hardness or operating parameters change.

What is needed, therefore, is an improved design process and resulting bit cutting structure that optimizes individual cutter force, torque, work, or power distribution across the face of the bit.

SUMMARY

Accordingly, an improved design process and resulting bit cutting structure is provided for drill bits wherein cutter geometries on the face of the bit are tailored to optimize the distribution of generated forces, torque, work, or power of each cutter relative to other cutters. Balanced are the forces, torque, work, or power generated by each cutter in respect to other cutters that are working within the same region of cut, so that all cutters within the same region of cut are generating sufficiently comparable forces, torque, work, or power. In this manner the cutters on the bit may share as closely as possible the work and loads required to penetrate the subterranean rock. References herein to forces, torque, work, or power are understood to mean at least one of these parameters and implementation preferences may call for the optimization of one, more than one, or all of the foregoing parameters.

In one example, the design process produces a bit structure in which each cutter is doing similar levels of work and/or creating similar levels of force, torque, or power relative to other cutters within the same region of cut on the bit, or among regions of cut on the bit, within specified ranges of design criteria.

BRIEF DESCRIPTION OF THE DRAWINGS

FIGS. 1A-1D illustrate an example embodiment of a bit design with unacceptable distribution of individual cutter forces, in which FIG. 1A is a diagrammatic, bottom view of a lower end surface of a drill bit having a plurality of cutting elements extending therefrom; FIG. 1B is a diagrammatic, axial view in cross section of the drill bit of FIG. 1A; FIG. 1C is an enlarged, broken-way view of a portion of one blade of cutting elements of the bit of FIG. 1A; and FIG. 1D is a perspective view of a drill bit.

FIGS. 2A-2C illustrate an example embodiment of a bit design with optimized distribution of individual cutter forces, in which FIG. 2A is a diagrammatic, bottom view of a lower end surface of a drill bit having a plurality of cutting elements extending therefrom; FIGS. 2B-2C are enlarged, broken-way views of a portion of one blade of cutting elements of the bit of FIG. 2A.

FIG. 4A is a flow chart illustrating an example wear value calculation process that may be utilized as part of the process of FIG. 3.

FIG. 4B is a graph illustrating the relationship between bit radius and wear value and diamond volume for an example bit design, generated from the wear value calculation process of FIG. 4A.

FIGS. 7A-7H, 8A-8C, 9A-9B, 10A-10C, 11A-11E, 12, and 13A-13F illustrate an example implementation of the bit design process of FIG. 3, showing displays of cutting structures and corresponding wear value, force and moment balance, and force distribution calculation plots for various iterations of the process.

FIGS. 14A-14B and FIGS. 15A-5B are representative examples of ways of comparing regions of a drill bit.

DETAILED DESCRIPTION

Figure 2A:
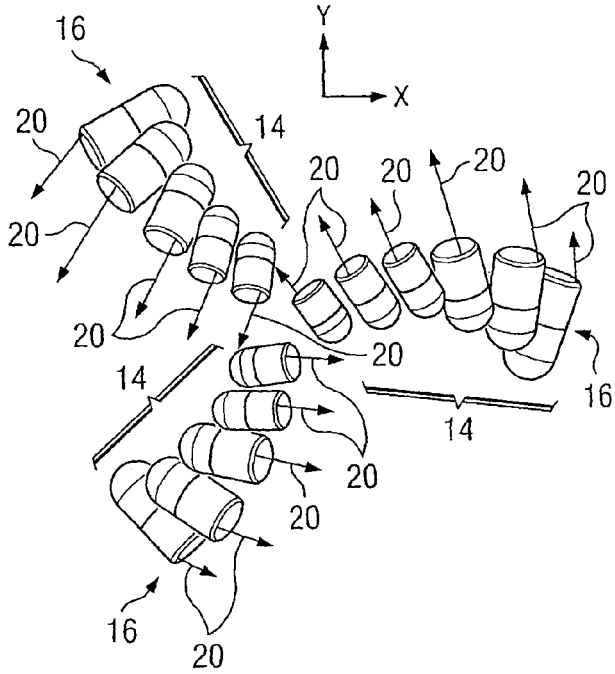

In one implementation, an energy balancing process for the design of a drill bit is employed that seeks to, as differentiated from the net force balancing of the bit, more evenly distribute individual cutter forces, torque, work, or power among cutters relative to other cutters in the same region of the bit. This promotes more even cutter wear over the bit cutting structure, bit stability and cutting efficiency. Starting with an initial bit design, an analysis is performed of the work, penetrating force, drag force, torque, or power of each cutter on the bit. A set of cutter parameter distribution design criteria is followed that establishes acceptable ranges of variance of at least one of these parameters from one cutter to the next. Specifically, the design criteria may involve establishing acceptable ranges or values of one or more of: total lateral bit moment imbalance; total variance in torque, work, power, drag force or axial force per cutter; total variance in average delta torque, work, power, drag force or axial force per cutter; or total variance in delta torque, work, power, drag force or axial force per cutter. It is understood that the per cutter analysis refers to cutters with non-zero force, torque, work, power values. The foregoing change in (delta) per cutter parameters, or average change in (delta) per cutter parameters, may be determined by comparing the cutter to its radially adjacent cutter, to one or more of its radially trailing and radially leading cutters, or to some other (e.g. lateral) arrangement of adjacent or nearby cutters. The foregoing total variance criteria may be applied to the cutters on the entire bit or alternatively to a single blade of cutters, on a blade-by-blade basis, or on some other designation of a region of cut.

It is understood that aspects of the disclosed processes may be defined and implemented in software in cooperation with, for example, a kinematics force model such as that developed by Amoco Research and/or other cutting analysis tools and graphics design programs run on a personal computer or workstation (not shown).

In FIGS. 1A-1D, the reference numeral 10 refers generally to a fixed cutter drill bit as one example of a drill bit structure for drilling subterranean formations. The bit 10 includes a unitary drill bit body 12 having a base portion 12*a* disposed about a longitudinal bit axis for receiving a rotational drive source (not shown), a gauge portion disposed about the longitudinal bit axis and extending from the base portion, and a face portion 12*c* disposed about the longitudinal bit axis and extending from the gauge portion. The bit body 12 usually has a curved profile, such that the cross-section profile (FIG. 1B) of the face portion 12*c* has a crown-shaped surface profile, usually a spherical, a parabolic, or other curved shape, depending upon the rock type to be drilled. While not shown, it is understood that in operation the bit 10 is connected to a drill string and a rotary drive which rotates at least part of the drill string together with the bit.

A plurality of polycrystalline diamond compact (PDC) cutters 14 are fixedly disposed on the face portion 12*c* of the bit 10 and are selectively spaced from one another. A thin polycrystalline diamond layer 14*a* of material on the leading face of each cutter 14 provides the wear-resistance that makes this type of cutter effective in drilling rock. The PDC layer 14*a* is bonded to a substrate of the cutter 14 and each cutter is attached to the bit face 12*c*, usually at an angle with a particular side rake and back rake as defined relative to the cutter profile. Specifically, the back rake is the angle of the cutter given relative to a line perpendicular to the cutter profile through the center of the cutter. This line gives the cutter tilt angle relative to the bit centerline. Back rake angles may range from about five (5) to forty (40) degrees. The side rake is the angle given relative to a line parallel to the profile tangency through the center of the cutter. Side rake angles may range from about zero (0) to twenty (20) degrees.

The number of the cutters 14, their orientation and position on the bit body 12, and other variables determine the performance of a bit in a given application. In one example as shown, the cutters 14 are arranged in the form of multiple blades 16 with a slight s-shaped curvature. The number of blades and their orientation, or other cutter pattern arrangements on the bit body 12, are a matter of design choice. For example, in some implementations, the cutters 14 are arranged so that the out-of-balance force created during drilling remains as small as possible. In other examples, such as for certain anti-whirl applications, the cutters 14 are arranged so that the imbalance force has purposely some values. This imbalance force is directed towards a low friction pad such that as the bit is rotated, the low friction pad will contact and slide against the borehole wall with relatively low friction and, therefore, backward whirling may be avoided.

For many applications, force balancing of the bit 10 is desirable to improve stabilization and bit performance. Force balancing involves manipulating cutter 14 placement and orientation across the bit face portion 12*a* to minimize any radial and torsional imbalance forces, reducing eccentric motion. The output of a kinematics force model produces a total imbalance force for the bit 10, represented graphically by the RESULT vector illustrated in FIG. 1A. The total imbalance force is defined as the summation of the total radial and total drag forces for all of the cutters 14. The total imbalance force can be expressed as a percentage of the weight-on-bit (WOB) by dividing the total imbalance force by the total WOB. In one example, a desirable design criterion for the bit 10 would be for the bit to have a total imbalance force of less than four percent (4%) of the WOB. Improved levels of force balancing may be achieved by further reducing this percentage, the tradeoff being that as the percentage decreases, the number of design iterations and time required to design the bit may increase.

Referring also to FIG. 1C, vectors 18 of varying length extending from the cutters 14 are shown to illustrate the magnitude of individual forces generated by each cutter as they compare to each other. The vectors 18 demonstrate a significant difference in magnitude of forces among the cutters 14 within a particular, example region, or multiple regions. Thus, while the RESULT vector of FIG. 1A may suggest an acceptable total imbalance force for the bit 10 because there is a low summation of all the lateral forces for the bit cutters 14, an unacceptable distribution of individual cutter 14 forces may exist because the magnitude of forces generated by each cutter 14 in respect to other cutters working in the same region of cut are not in balance with each other.

The design process for the bit 10, in addition to optimizing the total imbalance force for the bit, also seeks to optimize the loads (forces, torque, work, or power, for example) of individual cutters 14 relative to other cutters within the same region of cut, for (in some instances) a more even distribution of load. This is referred to generally as "energy balancing" of the bit 10.

Figure 2B:
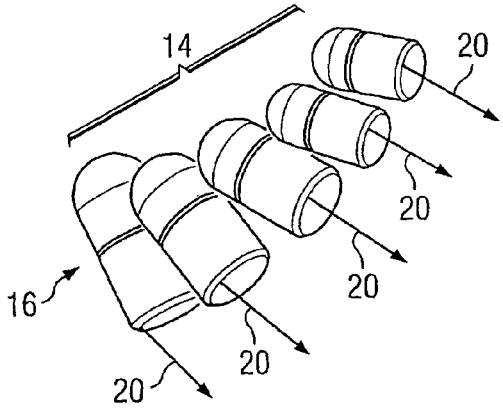
Figure 2C:
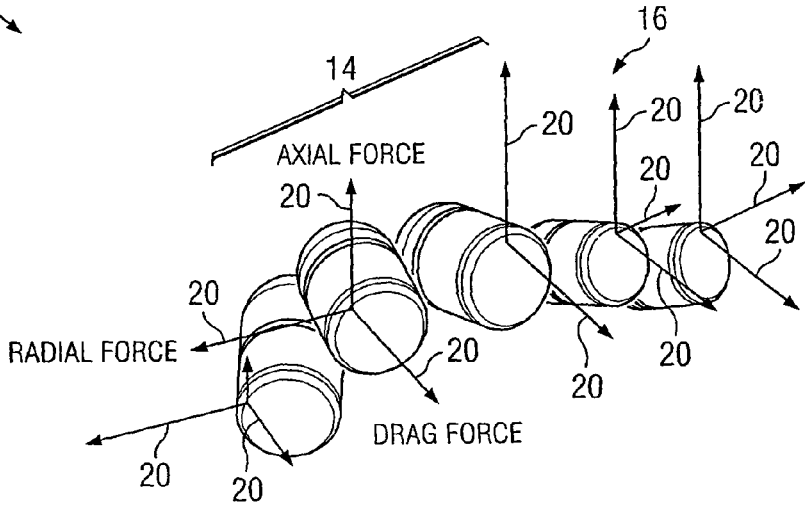

FIGS. 2A-2C illustrate force vectors for cutters 14 of the bit 10 after the process of energy balancing. FIGS. 2B-2C indicate force vectors 20 of relatively even length extending from the cutters 14, demonstrating a design that considers how the individual forces for each of the cutters 14 compares to other adjacent cutters or cutters within a particular region. The force vectors 20 indicate a relative balance of all the forces generated by each cutter 14 in respect to other cutters that are working within the same region of cut, such that the cutters on the bit 10 are sharing more equally, or as close as possible to equally, the loads.

Bit Design Process

Figure 3:
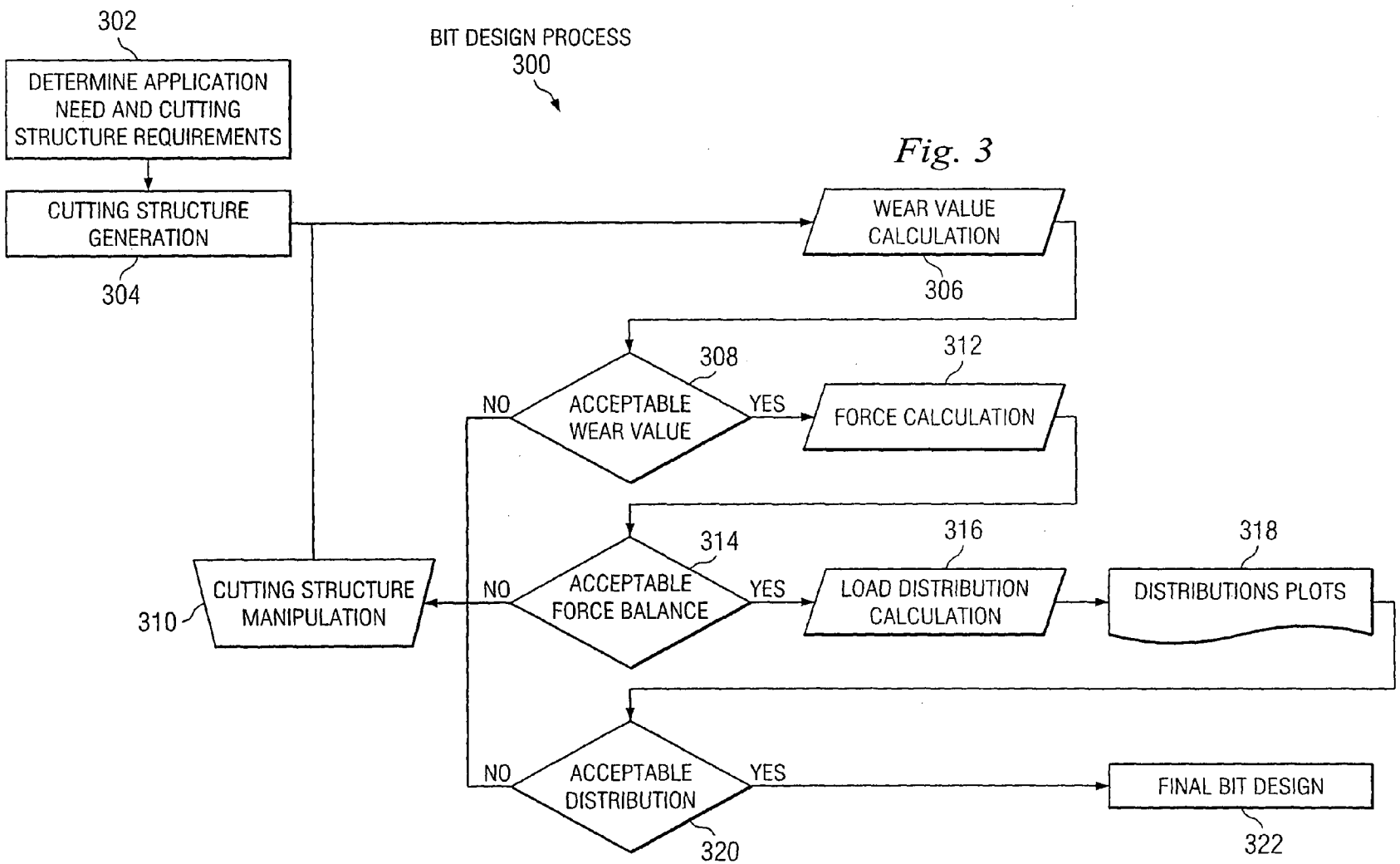
FIG. 3 is a flow chart illustrating a process for generating a bit design, such as the bit design of FIGS. 2A-2C, for example.

FIG. 3 illustrates a bit design process 300 that, inter alia, establishes design criteria on the distribution of individual cutter forces, torque, work, or power to more evenly distribute levels of force, torque, work, or power of cutters relative to each other within the same region of cut on the bit. The process 300 may be utilized, for example, to produce the bit 10 as described above with reference to FIGS. 2A-2C in which both total imbalance force and distribution of individual cutter forces, torque, work, or power are optimized for a particular drilling application.

Execution of the design process 300 begins with an initial definition of a bit design (step 302). An automated bit design tool, for example, is used to create a bit design file in which parameters for an initial geometry for the bit structure are defined, according to the particular drilling application need. The bit design tool may comprise menu-based input prompts and graphics generation routines that execute on a Microsoft Windows operating system. In one implementation, solid modeling computer aided design (CAD) software such as that available from Unigraphics may be utilized.

Input parameters for the initial drill bit design include, for example, bit size, bit profile, cutter back rake, cutter side rake, cutter spacing, cutter spiral, cutter type, blade count, blade radial start position, blade redundancy. Other design parameters may be utilized depending upon the particular bit being designed. Gauge cutter design parameters, bit body design parameters, and the like may also be specified. The input parameter specifications for the definition of the cutting structure are typically based on the designer's knowledge of the application, the rig equipment, and how it is to be used.

A cutting structure for the bit is generated based upon the design input parameter specifications (step 304). A wear value calculation is performed on the cutting structure of the bit design (step 306) to determine (step 308) whether the relative cutter wear rates for the bit design are acceptable. A wear value calculation process according to steps 306 and 308 is described in detail with reference to FIG. 4A, below. If the wear values indicate unacceptable relative cutter wear rates, the cutting structure of the bit design is manipulated (step 310) in a manner likely to produce improved wear value results. For example, additional cutters may be added, and/or their positions or orientations changed. The wear value calculation for the modified design is then performed (step 306) and wear value acceptability is determined (step 308). If unacceptable, the cutting structure is again manipulated (step 310) and the wear value evaluation process is repeated.

If wear value is acceptable, a force balance calculation (step 312) is performed on the bit design to determine (step 314) whether the bit geometry meets certain force balance criteria, as described in detail below with reference to the process of FIG. 5. If the force balance characteristics for the bit design are unacceptable, the cutting structure is manipulated (step 310) to modify the design accordingly. The wear value (step 306) and force balance (step 312) calculation processes are repeated until acceptability is determined.

If the bit design results in acceptable force balance characteristics that meet the desired criteria (step 314), force distribution calculations (step 316) on individual cutters are performed for the bit design which generate force distribution plots (step 318). The plots are utilized to determine (step 320) whether acceptable force distribution criteria are met for the bit design, as more fully explained below in FIG. 6A with reference to a force distribution process. If the force distribution characteristics for the bit design are unacceptable, the cutting structure is manipulated (step 310) to modify the design accordingly. The wear value (step 306), force balance (step 312), and force distribution (step 316) calculation processes are repeated until acceptability is determined. It is understood that all, less than all, or none, of the foregoing processes are repeated based upon the desire of the designer. It is also understood that the order in which steps of the process are performed may be varied. Upon the design meeting the desired acceptability criteria, a final design (step 322) is generated.

Wear Value Evaluation

FIGS. 4A and 4B illustrate a wear value calculation and evaluation process 400 that may be executed as part of the bit design process 300 (FIG. 3). Wear values are a simple way of looking at relative cutter wear rates. For the bit design, in one example, cutter geometry and cutter location data (step 402) are used as inputs to calculate the diamond volume radially per cutter (step 404) and to calculate the rock area removed radially per cutter (step 406). The diamond volume radially per cutter is summed (step 408) and used along with the rock area removed radially per cutter to calculate wear value (step 410). The result is a wear value and diamond volume curve (step 412 and FIG. 4B) that is evaluated to determine (step 308) whether relative cutter wear rates are acceptable. If not, the cutting structure is manipulated (step 310); if so, additional bit design criteria may be evaluated, such as determined by the force calculation (step 312).

Set forth below is an example of the manner in which wear value calculations may be performed:

Wear Value:

$$f = \sqrt{(p1_x - p2_x)^2 + (p1_y - p2_y)^2}$$

$$V = V + f \times stepsize \times \text{thickness} \times i$$

$$WV = WV + \frac{f \times stepsize \times \text{thickness} \times GRatio}{2 \times \pi \times \text{grid} \times stepsize^2}$$

a. p are the intersection points on the diamond table at the current grid b. f is the distance between the points p c. grid is the radial integer position of the points d. V is the diamond volume at the grid position e. stepsize is the step radial thickness of the grid f. thickness is the step thickness along the cutter axis g. i is either −1 or 1 depending on the material type being summed Wear value numbers are presented graphically as illustrated in FIG. 4B. As described above, the data is generated by computing the diamond volume at a given radial step, multiplying by the wear ratio of rock to diamond (G-Ratio) then dividing by the area at the given radial step.

The graph of FIG. 4B plots wear value and diamond volume (inches cubed) as a function of bit radius (inches). Wear value is a dimensionless unit that generally shows that as the bit radius increases across the face of the bit, wear or rate of wear on the cutter becomes higher. With reference to the graph, wear value and diamond quantity plots should show relatively consistent trends from centerline to gauge of the bit radius. One peak generally occurs around the bit profile nose. The wear value is a general indication of the spacing of the cutting structure indicating weak or strong points along the radius. Spikes in the wear value indicate that area of the bit will wear more quickly than the other areas. A design preference, for example, may be to provide a cutting structure for the bit that eliminates significant spikes in the graphs, corresponding to the weak (high wear) areas. A sharp peak in the wear value and a dip in diamond quantity therefore may call for a modification of the cutting structure. Alternatively, bits which incorporate redundancy, for example, may show many peaks in the wear value graph, which may be an acceptable condition.

Force Balance Evaluation

A total force balance calculation and evaluation process may be implemented as part of the bit design process 300 (FIG. 3). In designing a drill bit (such as, for example, drill bit 10), a primary step towards a achieving a stable running bit is to provide a cutting structure that does not attempt to translate laterally during normal drilling. Force balancing accomplishes this by minimizing any radial and torsional imbalance forces, reducing eccentric motion. Each cutter 14 exerts forces on the formation as the bit 10 rotates and penetrates. These forces are the penetrating force, on a plane parallel to the bit 10 centerline, and drag force, perpendicular to a plane through the bit centerline. Kinematic models derived from laboratory cutter testing are able to estimate these forces for given operating conditions and formation characteristics.

A computer model, for example, receives as inputs (typically as an ASCII file) a full description of cutter positions and their rake angles, formation compressive strength, rate of penetration (ROP), and rotations per minute (RPM). Models may also receive as input weight on bit (WOB) and output of ROP. The model utilizes an integration method for development of the cutter engagement geometries and bottom hole pattern, taking into account the three dimensional cutter positions. Once the engagement of each integration step across the entire bit face has been determined, the drag and penetrating forces are calculated and summed for each individual cutter. Work rates and volumetric cutter wear rates are also calculated. Vertical components of forces may be summed to estimate WOB. Drag forces are multiplied by their respective moment arms to compute bit torque. Radial forces are summed to compute the radial imbalance force. Drag imbalance can be expressed either by a simple sum of drag forces or as a computation of the net bending moment about the bit centerline. If extended runs are to be simulated, the model may be utilized to "wear" the cutters by removing the computed amount of cutter volume and simulating a wear flat for the given time interval, whereupon forces can be recalculated as described above. The process is repeated until a desired depth drilled has been simulated.

Using the kinematic model, force balancing involves adjusting the cutting structure of the drill bit design to reduce the imbalance numbers, according to a specific set of design criteria which accounts for both linear radial and moment imbalances and their relationship to each other. Example design criteria are described below.

Figure 5:
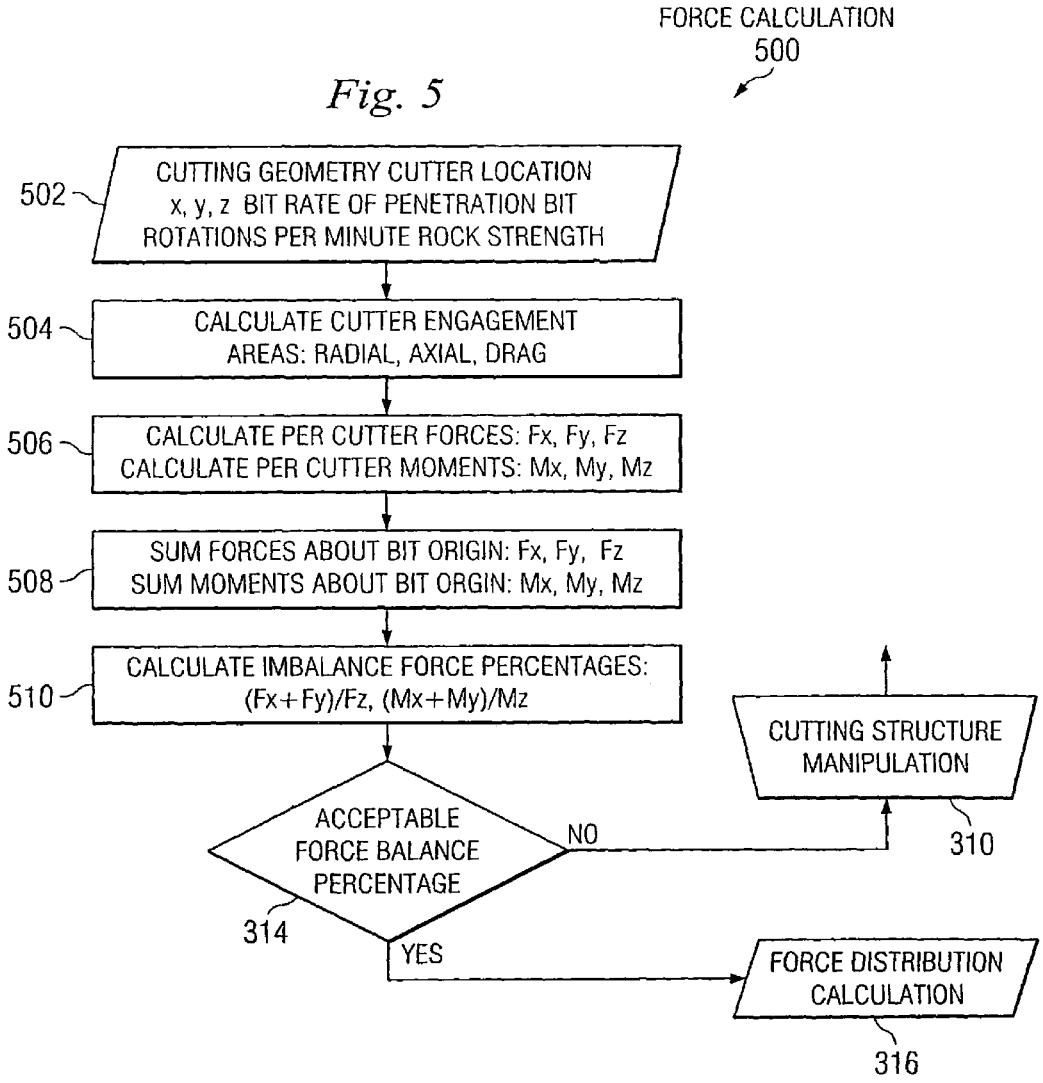
FIG. 5 is a flow chart illustrating an example force balance calculation process that may be utilized as part of the process of FIG. 3.

FIG. 5 illustrates a specific example of a total force balance calculation and evaluation process 500 that may be implemented as part of the bit design process 300 (FIG. 3). For the bit design, information needed to properly orient each cutter and determine how the cutters interact with one another to produce the resultant imbalance forces is received as input (step 502). Information received as input may include, for example, cutter geometry, cutter location (x, y, z) bit rate of penetration (ROP), bit rotations per minute (RPM), rock strength. Cutter engagement areas (radial, axial, and drag) are calculated (step 504). Per cutter forces (fx, fy, fz) and per cutter moments (Mx, My, Mz) are calculated (step 506). The forces about bit origin (fx, fy, fz) and the moments about bit origin (Mx, My, Mz) are summed (step 508). Bit imbalance force percentages ((Fx+Fy)/Fz; (Mx+My)/Mz) are calculated (step 510).

Given the calculated bit imbalance force percentages for the design, a determination is made by the designer as whether the values are acceptable (step 314). For example, acceptable force balance criteria may be a radial force imbalance of less than three percent (3%) of WOB; a drag force imbalance of less than three percent (3%) of WOB; and a total force imbalance of less than four percent (4%) of WOB. If the force balance characteristics of the bit are not acceptable, the cutting structure is manipulated (step 310) and the calculation processes are repeated for the modified design until an acceptable criteria are met.

Cutting structure manipulation in the case of unacceptable force balance characteristics may include modification of cutter position or orientation (e.g., change a blade of cutters' or a single cutter's angular position; move a cutter along the profile in a radial direction; change the back rake or side rake of one or more cutters).

Set forth below is an example of the manner in which force balance calculations may be performed:

Force Balance Model:

1. Calculate Cutter Engagement $$\text{bit}y=\text{bit}y-ppr\times(\text{old}da-da)$$

$$\text{delta}=bh-y-\text{bit}y$$

a. bity is the current position of the bit
b. ppr is the penetration per radian
c. old_da is the previous angular position of the bit
d. da is the angular position of the current cutter segment
e. y is the position of the cutter
f. bh is the current position of the rock
g. delta is the depth of cut or the cutter engagement 2. Calculate Cutter Forces $$ps=c_1\times pa^{c2}$$

$$p=pa\times ps$$

$$ds=c3$$

$$d=ds\times da+p\times c4$$

$$\overrightarrow{cpf}=\overrightarrow{cpf}+\vec{p}$$

$$\overrightarrow{cpm}=\overrightarrow{cpm}+\vec{r}\times\vec{p}$$

$$\overrightarrow{cdf}=\overrightarrow{cdf}+\vec{d}$$

$$\overrightarrow{cdm}=\overrightarrow{cdm}+\vec{r}\times\vec{d}$$

a. p is the penetration force
b. d is the drag force
c. pa is penetrating area
d. da is the drag area
e. ps is the penetrating force stress
f. ds is the drag force stress
g. cpf is the sum of the penetrating forces to center of cutter
h. cpm is the sum of the penetrating moments to center of cutter
i. cdf is the sum of the drag forces to center of cutter
j. cdr is the sum of the drag moments to center of cutter
k. r is the distance from the force to the center of the cutter
l. c1, c2, c3 & c4 are a constants 3. Sum Forces on Bit $$\vec{bf}=\vec{bf}+\overrightarrow{cpf}+\overrightarrow{cdf}$$

$$\overrightarrow{bm}=\overrightarrow{bm}+\vec{r}\times(\overrightarrow{cpf}+\overrightarrow{cdf})+\overrightarrow{cdm}+\overrightarrow{cpm}$$

a. bf is the summed bit forces
b. bm is the summed bit moments
c. r is the radial position of the center of the cutter 4. Calculate Bit Imbalance $$btp=\frac{bf_x+bf_y}{bf_z}\times 100$$

$$btm=bf_x+bf_y$$

$$btd=\tan^{-1}\left(\frac{bf_y}{bf_x}\right)$$

a. btp is the percent imbalance of the bit
b. btm is the magnitude of the imbalance of the bit
c. btd is the direction of the imbalance of the bit Force, Torque, Work, Power Distribution Evaluation FIGS. 6A-6L illustrate a force, torque, work, or power distribution calculations and evaluation processes that may be executed as part of the bit design process 300 (FIG. 3). The processes seek a design that evenly distributes the cutter forces, torque, work, or power in the same region of cut, and that also has a low total lateral moment imbalance.

In one example, acceptable distribution criteria used in evaluation of a bit design are one or more of the following:

(1) total variance in average cutter parameter (i.e., torque, work, power, drag force, or axial force per cutter) for the entire bit;
(2) total variance of average change in cutter parameter (i.e., torque, work, power, drag force, or axial force per cutter) for the cutter and its radially trailing and leading cutter;
(3) total variance of change in cutter parameter (i.e., torque, work, power, drag force, or axial force per cutter) for the cutter relative to its radially trailing cutter; and
(4) total lateral bit moment imbalance of the bit.

Change or average change in cutter parameter(s) may alternatively be determined by comparing a cutter to one or more adjacent or nearby cutters spaced laterally, radially, per blade, or otherwise spaced from the individual cutter of interest.

Figure 6A:
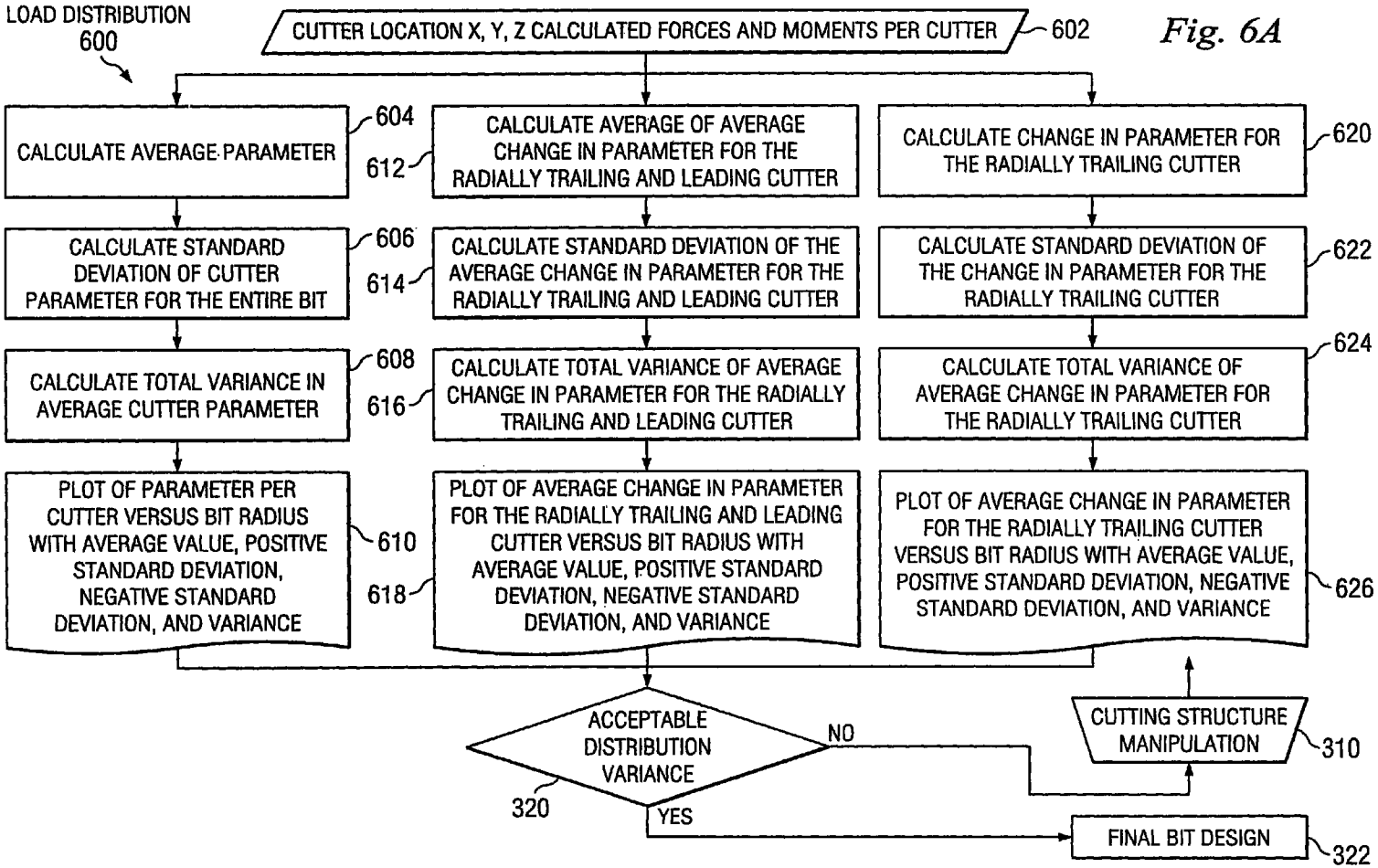
FIG. 6A-6B are flow charts illustrating example cutter parameter distribution calculation processes that may be utilized as part of the process of FIG. 3.
Figures 1, 6B:
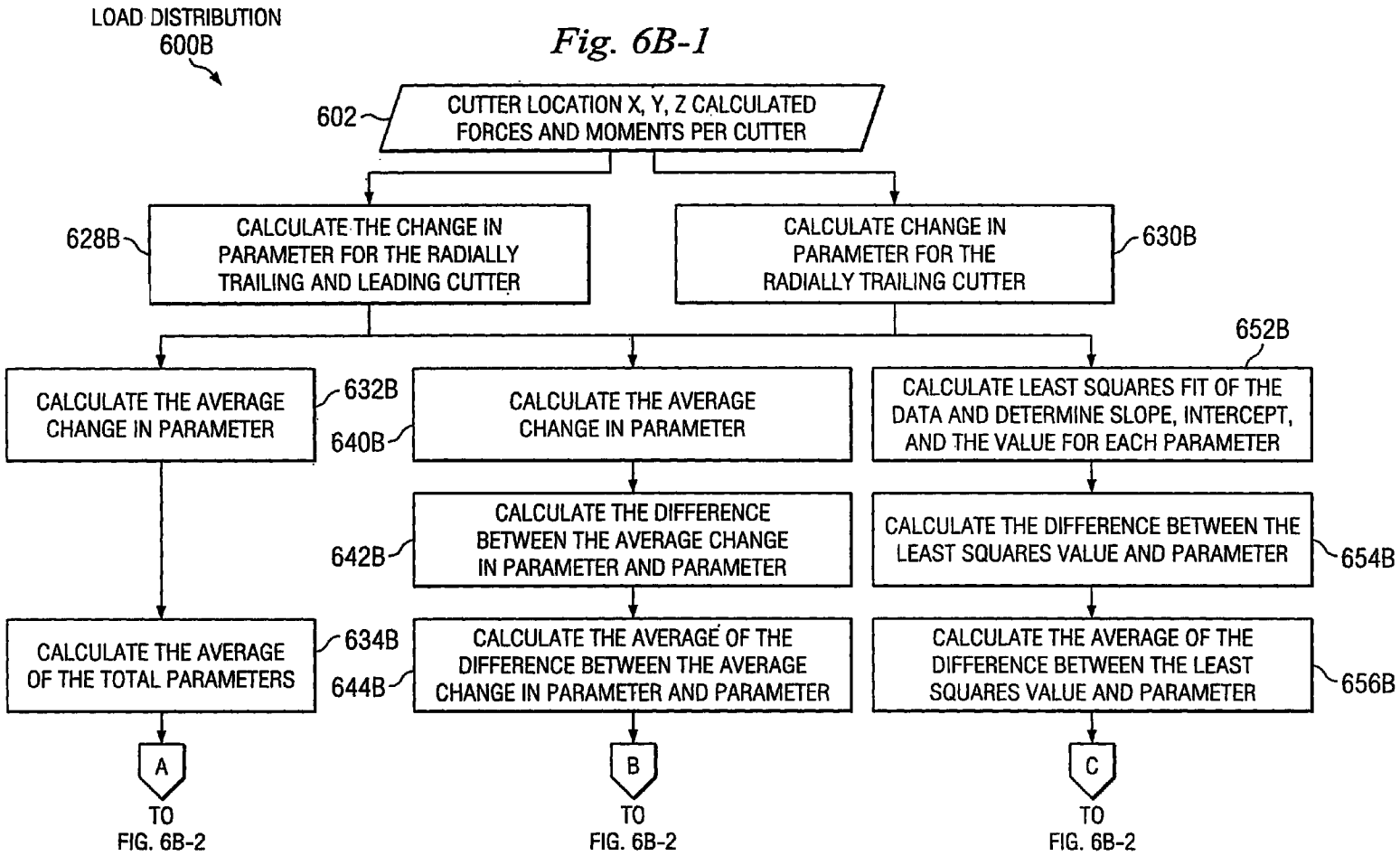
Figures 2, 6B:
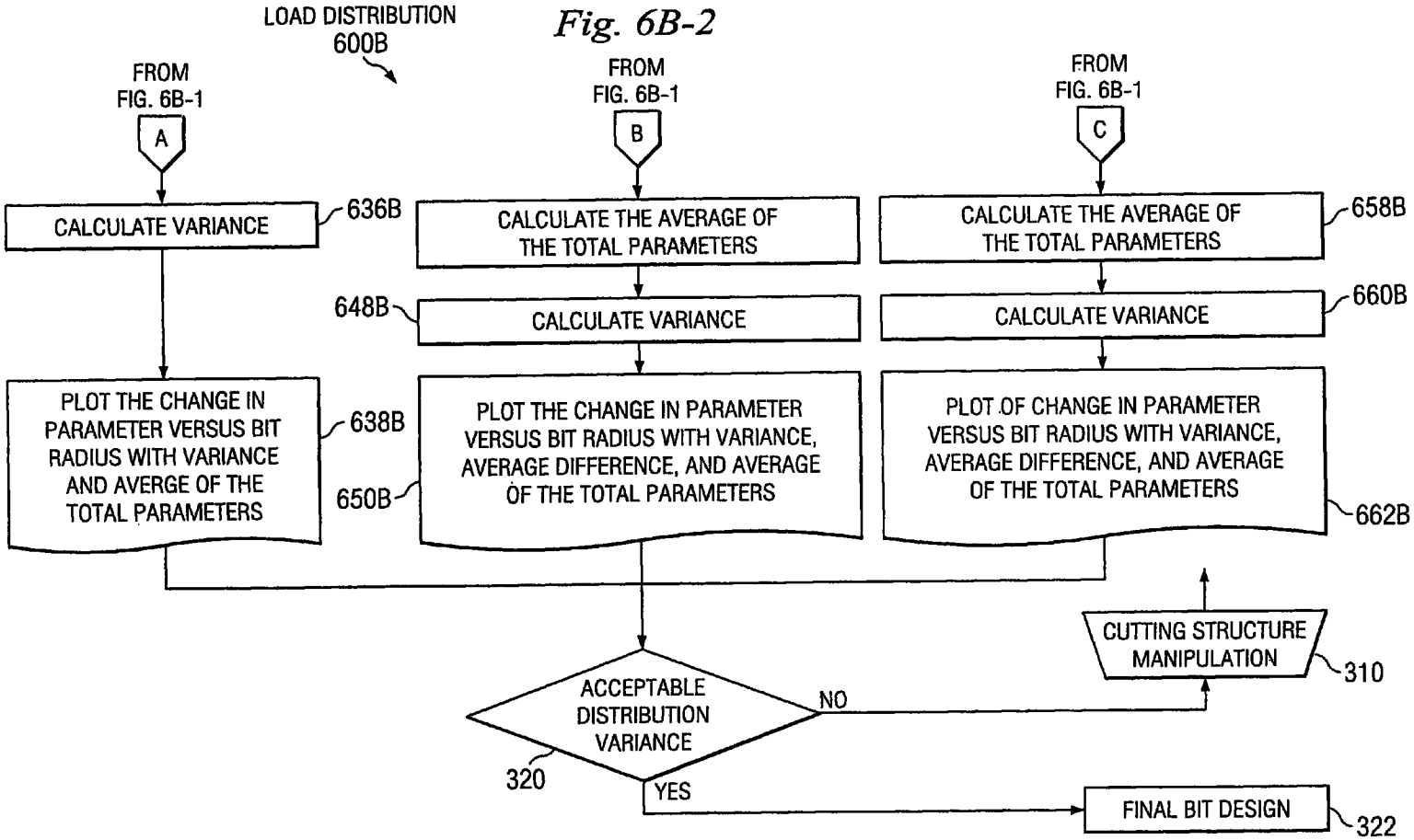

FIG. 6A illustrates a process 600A for determining whether a bit design meets acceptable distribution criteria (1)-(3) above, and manipulating the cutting structure accordingly to achieve a final bit design. FIG. 6B illustrates an alternative, preferred process 600B directed more particularly to determining whether the bit design meets criteria (2) above (step 628B) and criteria (3) above (step 630B).

Referring to FIGS. 6A-6B, information for the bit design needed to properly orient each cutter and determine how the cutters interact with one another is received as input (step 602). Information received as input includes cutter location (x, y, z) and the calculated forces and moments per cutter. As discussed in more detail below, steps 604-610 (FIG. 6A) illustrate an example of determining and evaluating the total variance in average cutter parameter (criteria (1) above); steps 612-618 (FIG. 6A) illustrate an example of determining and evaluating total variance of average change in cutter parameter for the cutter and its radially trailing and leading cutter (criteria (2) above); and steps 620-626 (FIG. 6A) illustrate an example of determining and evaluating total variance of change in cutter parameter for the cutter relative to its radially trailing cutter (criteria (3) above). Step 628B (FIG. 6B) illustrates different examples of determining and evaluating total variance of average change in cutter parameter for the cutter and its radially trailing and leading cutter (criteria (2) above), according to three separate processes defined by steps 632B-638B; steps 640B-650B; and steps 652B-662B. Step 630B (FIG. 6B) illustrates different examples of determining and evaluating total variance of average change in cutter parameter for the cutter and its-radially trailing cutter (criteria (3) above), according to the three separate processes defined by steps 632B-638B; steps 640B-650B; and steps 652B-662B.

In FIG. 6A, steps 604-610 determine the total variance in average cutter parameter (i.e., torque, work, power, drag force, or axial force for the entire bit (step 608) and generate a plot of the parameter per cutter versus bit radius with average value, positive and negative standard deviation, and variance (step 610).

For example, a desired bit design may call for a total variance in average cutter parameter (i.e., torque, work, power, drag force, or axial force) of less than one hundred percent (100%).

Cutter torque is defined as a particular cutter's contribution of bit torque ($M_Z$). Cutter torque is calculated by first determining the force magnitudes ($F_X$, $F_Y$ & $F_Z$) and force locations ($R_X$, $R_Y$ & $R_Z$) on a cutter from the kinematics force model, such as that developed by Amoco Research. The cross product of the position vector, R and the force vector F gives the moment vector M ($M_X$, $M_Y$ & $M_Z$). The moment along the z-axis is cutters contribution of bit torque.

Cutter work is defined as a particular cutter's contribution of bit work. Cutter work is calculated by first determining the force magnitudes ($F_X$, $F_Y$ & $F_Z$) and force velocity ($V_X$, $V_Y$ & $V_Z$) on a cutter using the force model. The dot product of the velocity vector, V and the force vector F gives the cutter power, P. Multiplying P by the drilling time gives the cutter work, W.

Cutter power is defined as a particular cutter's contribution of bit power. Cutter power is calculated by first determining the force magnitudes ($F_X$, $F_Y$ & $F_Z$) and force velocity ($V_X$, $V_Y$ & $V_Z$) on a cutter using the force model. The dot product of the velocity vector, V and the force vector F gives the cutter power, P.

Cutter drag force is defined as a particular cutter's resistance to cutting the rock. Cutter drag force is calculated by first determining the force magnitudes ($F_X$, $F_Y$ & $F_Z$) along the velocity vector using the force model. The summation of the forces is the drag force ($F_D$=$F_X$+$F_Y$).

Cutter axial force is defined as a particular cutter's resistance to penetrating the rock. Cutter axial force is calculated by first determining the penetrating force magnitudes ($F_X$, $F_Y$ & $F_Z$) using the force model. The force in the z direction is the axial force ($F_Z$).

In step 604, the average cutter torque, work, power, drag force or axial force is calculated by summing the per cutter torque, work, power, drag force or axial force of all non-zero values then dividing by the total number of non-zero values.

In step 606, the standard deviation of cutter torque, work, power, drag force or axial force is calculated by multiplying the total number of non-zero values by the sum of the squares of the per cutter torque, work, power, drag force or axial force of all non-zero values, subtracting the square of the sums of the per cutter torque, work, power, drag force or axial force of all non-zero values, dividing by the square of the total number of non-zero values (variance) then taking the square root (standard deviation).

In step 608, the total variance in torque, work, power, drag force or axial force per cutter is calculated by dividing standard deviation (e) by the average (d) and multiplying by 100.

Figure 6C:
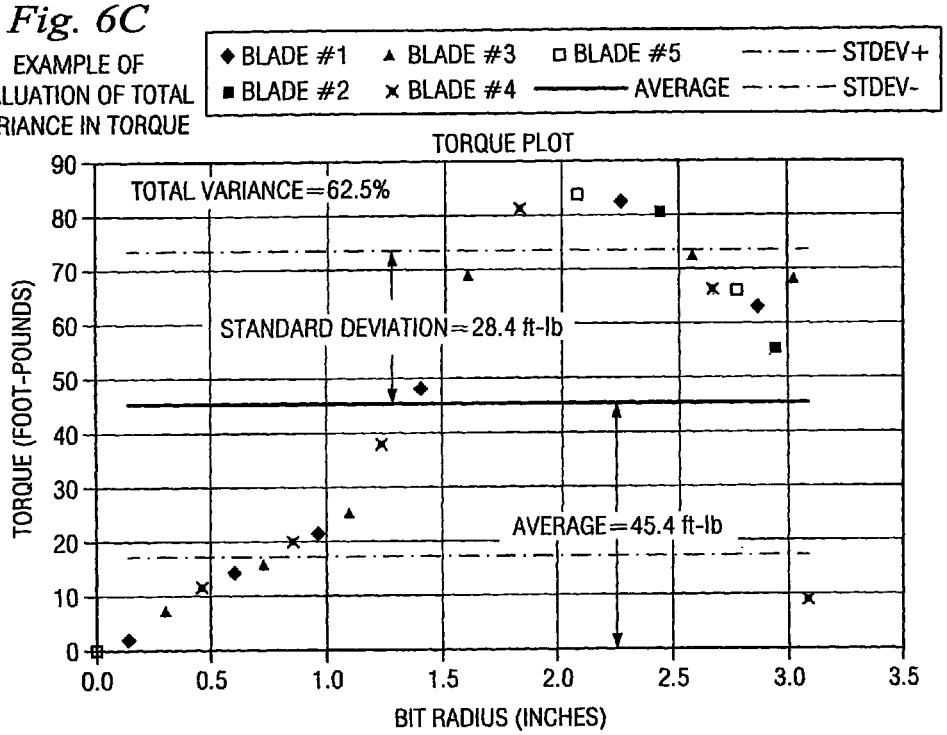
FIG. 6C is a graph illustrating a plot of the parameter per cutter versus bit radius, with average value, positive standard deviation, negative standard deviation, and variance, for an example bit design, generated from a force distribution calculation process of FIGS. 6A-6B.

Referring also to FIG. 6C, there is illustrated a representative plot of the parameter per cutter versus bit radius including variance and standard deviation information (step 610).

In FIG. 6A, steps 612-618 determine the total variance in average change in cutter parameter (i.e., torque, work, power, drag force, or axial force) for the radially trailing and leading cutter (step 616) and generate a plot of the average change in parameter for the radially trailing and leading cutter versus bit radius with average value, positive and negative standard deviation, and variance (step 618).

By organizing cutters by radial position, they may be defined from least to greatest or from i equal 1 to the number of non-zero values.

Average delta (i.e., change in) cutter torque is defined as the average change in torque (torque as defined above) between one radial adjacent cutter with a smaller radial position than the current cutter and one radial adjacent cutter with a greater radial position than the current cutter. Average delta torque is calculated by taking the absolute value of the difference of $T_i$ and $T_{i-1}$, adding it to the absolute value of the difference of $T_i$ and $T_{i+1}$ then dividing by two.

Average delta cutter work is defined as the average change in work (work as defined above) between one radial adjacent cutter with a smaller radial position than the current cutter and one radial adjacent cutter with a greater radial position than the current cutter. Average delta work is calculated by taking the absolute value of the difference of $W_i$ and $W_{i-1}$, adding it to the absolute value of the difference of $W_i$ and $W_{i+1}$ then dividing by two.

Average delta cutter power is defined as the average change in power (power as defined above) between one radial adjacent cutter with a smaller radial position than the current cutter and one radial adjacent cutter with a greater radial position than the current cutter. Average delta power is calculated by taking the absolute value of the difference of $P_i$ and $P_{i-1}$, adding it to the absolute value of the difference of $P_i$ and $P_{i+1}$ then dividing by two.

Average delta cutter drag force is defined as the average change in drag force (drag force as defined above) between one radial adjacent cutter with a smaller radial position than the current cutter and one radial adjacent cutter with a greater radial position than the current cutter. Average delta cutter drag force is calculated by taking the absolute value of the difference of $DF_i$ and $DF_{i-1}$, adding it to the absolute value of the difference of $DF_i$ and $DF_{i+1}$ then dividing by two.

Average delta cutter axial force is defined as the average change in axial force (axial force as defined above) between one radial adjacent cutter with a smaller radial position than the current cutter and one radial adjacent cutter with a greater radial position than the current cutter. Average delta axial force is calculated by taking the absolute value of the difference of $AF_i$ and $AF_{i-1}$, adding it to the absolute value of the difference of $AF_i$ and $AF_{i+1}$ then dividing by two.

In steps 612-616, the total variance in average delta torque, work, power, drag force or axial force per cutter is determined as follows. The average of the average delta cutter torque, work, power, drag force or axial force is calculated by summing the per cutter average delta torque, work, power, drag force or axial force of all non-zero values then dividing by the total number of non-zero values (step 612). In step 614, the standard deviation of the average delta cutter torque, work, power, drag force or axial force is calculated by multiplying the total number of non-zero values by the sum of the squares of the per cutter average delta torque, work, power, drag force or axial force of all non-zero values, subtracting the square of the sums of the per cutter average delta torque, work, power, drag force or axial force of all non-zero values, dividing by the square of the total number of non-zero values (variance) then taking the square root (standard deviation). In step 616, the total variance in average delta torque, work or power per cutter is calculated by dividing standard deviation (e) by the average (d) and multiplying by 100. According to one example using this calculation a desired bit design may call for a total variance in average change in cutter parameter (i.e., torque, work, power, drag force, or axial force) per cutter [for the radially trailing and leading cutter] of less than one hundred percent (100%).

Referring to FIG. 6B, as an alternative to the process of steps 612-616, the total variance in average delta torque, work or power per cutter for the cutter and its radially trailing and radially leading cutter is calculated as shown by step 628B. Generally, steps 632B-638B; steps 640B-650B; or steps 652B-662B are followed. See also representative graphs as shown in FIGS. 6F, 6G, 6H, and 6I. For example:

(1) First, the average parameter of the average delta cutter torque, work, power, drag force or axial force is calculated by either: (a) summing the per cutter average delta torque, work, power, drag force or axial force of all non-zero values then dividing by the total number of non-zero values (steps 632B-634B) (FIG. 6G); (b) summing the difference between the average difference and the actual difference of all non-zero values then dividing by the total number of non-zero values (steps 640B-646B) (FIG. 6H); or (c) calculating a least squares linear fit of the average delta parameter versus bit radius then summing the difference between the linear fit difference and the actual difference of all non-zero values then dividing by the total number of non-zero values (steps 652-658) (FIG. 6I).

(2) Calculate the average parameter by summing the per cutter torque, work, power, drag force or axial force of all non-zero values then dividing by the total number of non-zero values (as part of either step 636B, 648B, or 660B). See FIG. 6F.

(3) The total variance in average delta torque, work, power, drag force or axial force per cutter is calculated by dividing average (1) by the average (2) and multiplying by 100 (as part of either step 636B, 648B, or 660B). According to one example using this calculation a desired bit design may call for a total variance in average change in cutter parameter (i.e., torque, work, power, drag force, or axial force) per cutter for the radially trailing and leading cutter of less than five percent (5%).

Figure 6D:
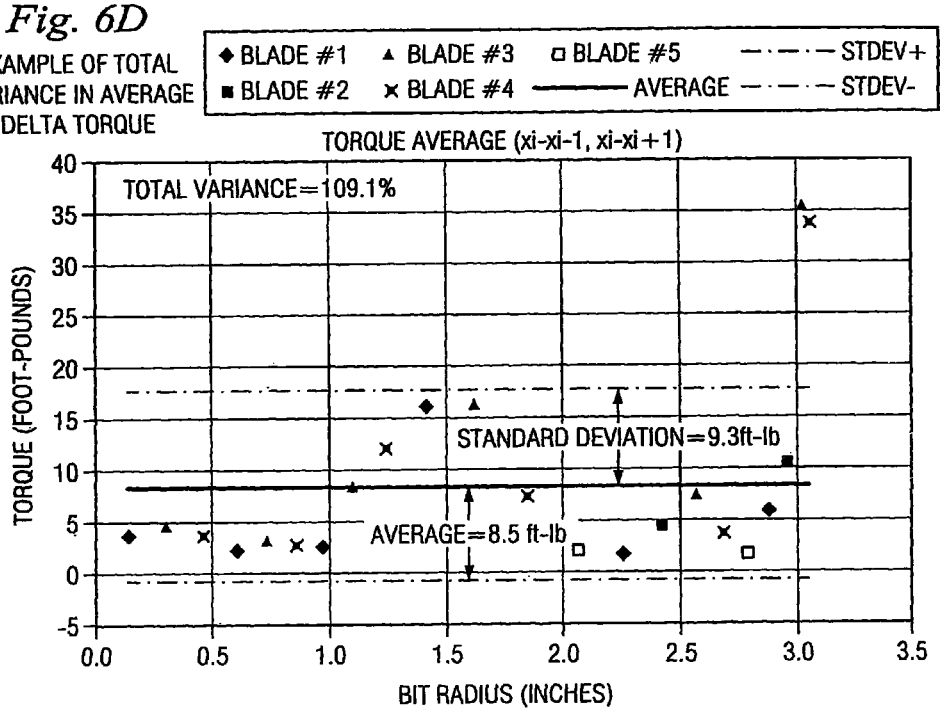
FIG. 6D is a graph illustrating a plot of the average change in parameter for the radially trailing and leading cutter versus bit radius, with average value, positive standard deviation, negative standard deviation, and variance, for an example bit design, generated from a force distribution calculation process of FIGS. 6A-6B.

Referring also to FIG. 6D, there is illustrated a representative plot of the average change in parameter per cutter for the radially trailing and leading cutter versus bit radius including variance and standard deviation information (step 618).

In FIG. 6A, steps 620-626 determine the total variance in change in cutter parameter (i.e., torque, work, power, drag force, or axial force) for the radially trailing cutter (step 624) and generate a plot of the change in parameter for the radially trailing cutter versus bit radius with average value, positive and negative standard deviation, and variance (step 626).

By organizing cutters by radial position, they may be defined from least to greatest or from i equal 1 to the number of non-zero values.

Delta cutter torque is defined as the change in torque (torque as defined above) between one radial adjacent cutter with a greater radial position than the current cutter. Delta torque is calculated by taking the absolute value of the difference of $T_i$ and $T_{i+1}$.

Delta cutter work is defined as the change in work (work as defined above) between one radial adjacent cutter with a greater radial position than the current cutter. Delta work is calculated by taking the absolute value of the difference of $W_i$ and $W_{i+1}$.

Delta cutter power is defined as the change in power (power as defined above) between one radial adjacent cutter with a greater radial position than the current cutter. Delta power is calculated by taking the absolute value of the difference of $P_i$ and $P_{i+1}$.

Delta cutter drag force is defined as the change in drag force (drag force as defined above) between one radial adjacent cutter with a greater radial position than the current cutter. Delta drag force is calculated by taking the absolute value of the difference of $DF_i$ and $DF_{i+1}$.

Delta cutter axial force is defined as the change in axial force (axial force as defined above) between one radial adjacent cutter with a greater radial position than the current cutter. Delta axial force is calculated by taking the absolute value of the difference of $AF_i$ and $AF_{i+1}$.

Average of the delta cutter torque, work, power, drag force or axial force is calculated by summing the per cutter delta torque, work, power, drag force or axial force of all non-zero values then dividing by the total number of non-zero values (step 620). In step 622 the standard deviation of the delta cutter torque, work, power, drag force or axial force is calculated by multiplying the total number of non-zero values by the sum of the squares of the per cutter delta torque, work, power, drag force or axial force of all non-zero values, subtracting the square of the sums of the per cutter delta torque, work, power, drag force or axial force of all non-zero values, dividing by the square of the total number of non-zero values (variance) then taking the square root (standard deviation). In step 624 the total variance in delta torque, work, power, drag force or axial force per cutter is calculated by dividing standard deviation (e) by the average (d) and multiplying by 100. For example, using this calculation, a desired bit design may call for a total variance in average change in cutter parameter (i.e., torque, work, power, drag force, or axial force) for the radially trailing bit of less than one hundred percent (100%).

Referring to FIG. 6B, as an alternative to the process of steps 620-626, the total variance in average delta torque, work or power per cutter for the cutter and its radially trailing cutter is calculated as shown by step 630B. Generally, steps 632B-638B; steps 640B-650B; or steps 652B-662B are followed. See also FIGS. 6F, 6J, 6K 6L. For example:

(1) First, the average parameter of the delta cutter torque, work, power, drag force or axial force is calculated by either: (a) summing the per cutter delta torque, work, power, drag force or axial force of all non-zero values then dividing by the total number of non-zero values (steps 632B-634B) (FIG. 6J); (b) summing the difference between the difference and the actual difference of all non-zero values then dividing by the total number of non-zero values (steps 640B-646B) (FIG. 6K); or (c) calculating a least squares linear fit of the delta parameter versus bit radius then summing the difference between the linear fit difference and the actual difference of all non-zero values then dividing by the total number of non-zero values (steps-652B-658B) (FIG. 6L).

(2) Calculate the average parameter by summing the per cutter torque, work, power, drag force or axial force of all non-zero values then dividing by the total number of non-zero values (as part of either step 636B, 648B, or 660B). See FIG. 6F.

(3) The total variance in delta torque, work, power, drag force or axial force per cutter is calculated by dividing average (1) by the average (2) and multiplying by 100 (as part of either step 636B, 648B, or 660B). According to one example using this calculation a desired bit design may call for a total variance in change in cutter parameter (i.e., torque, work, power, drag force, or axial force) per cutter [for the radially trailing cutter] of less than five percent (5%).

Figure 6E:
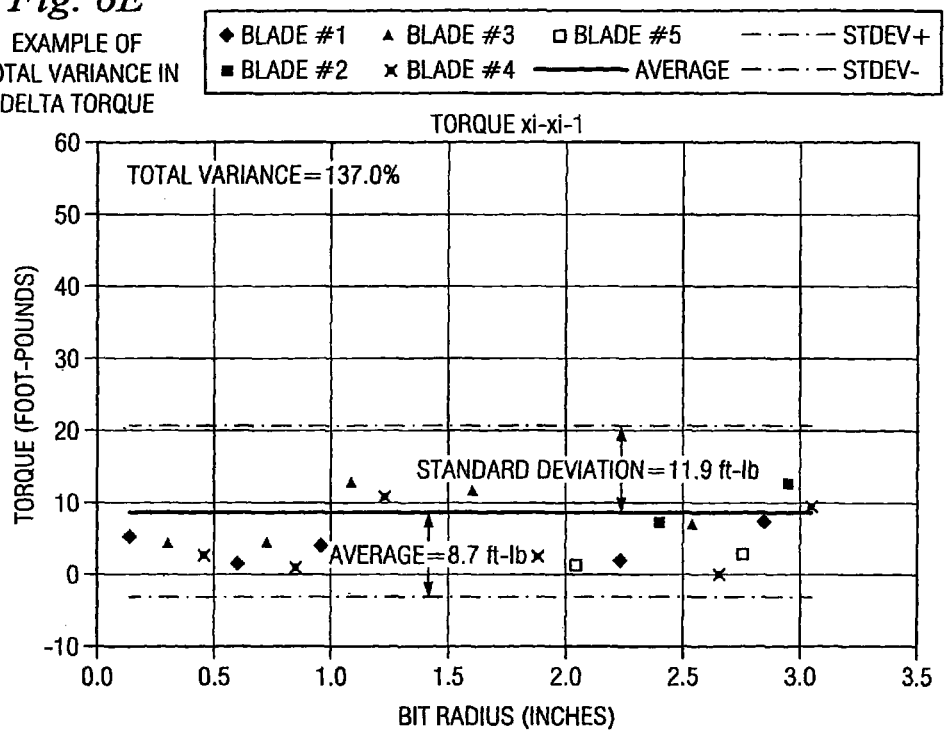
FIG. 6E is a graph illustrating a plot of the average change in parameter for the radially trailing cutter versus bit radius, with average value, positive standard deviation, negative standard deviation, and variance, for an example bit design, generated from force distribution calculation processes of FIGS. 6A-6B.
Figure 6F:
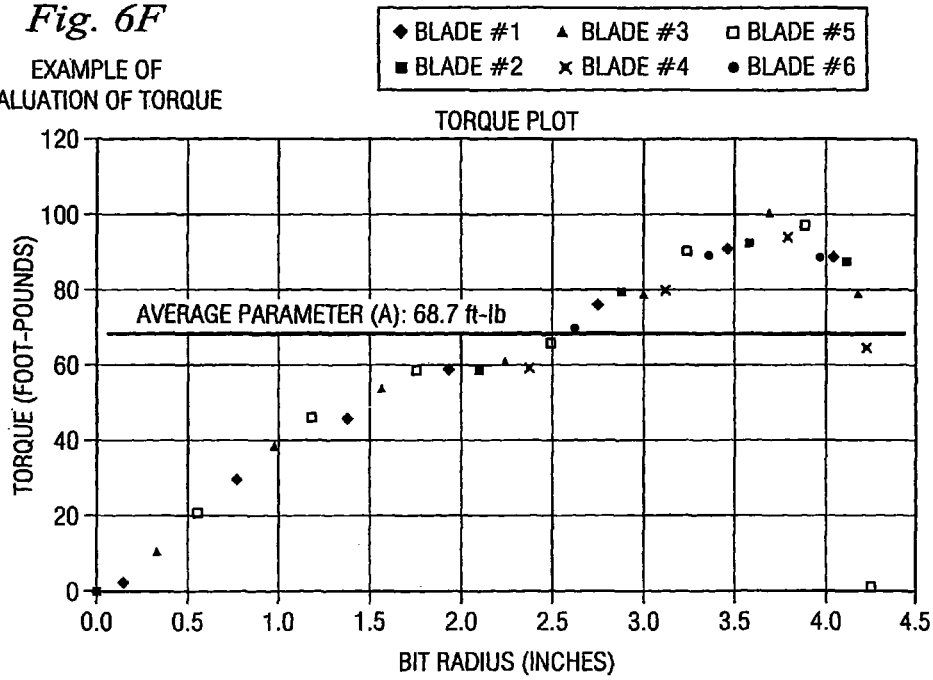
FIGS. 6F-6L are graphs illustrating plots of example evaluations of parameters using the calculation processes of FIG. 6A.
Figure 6G:
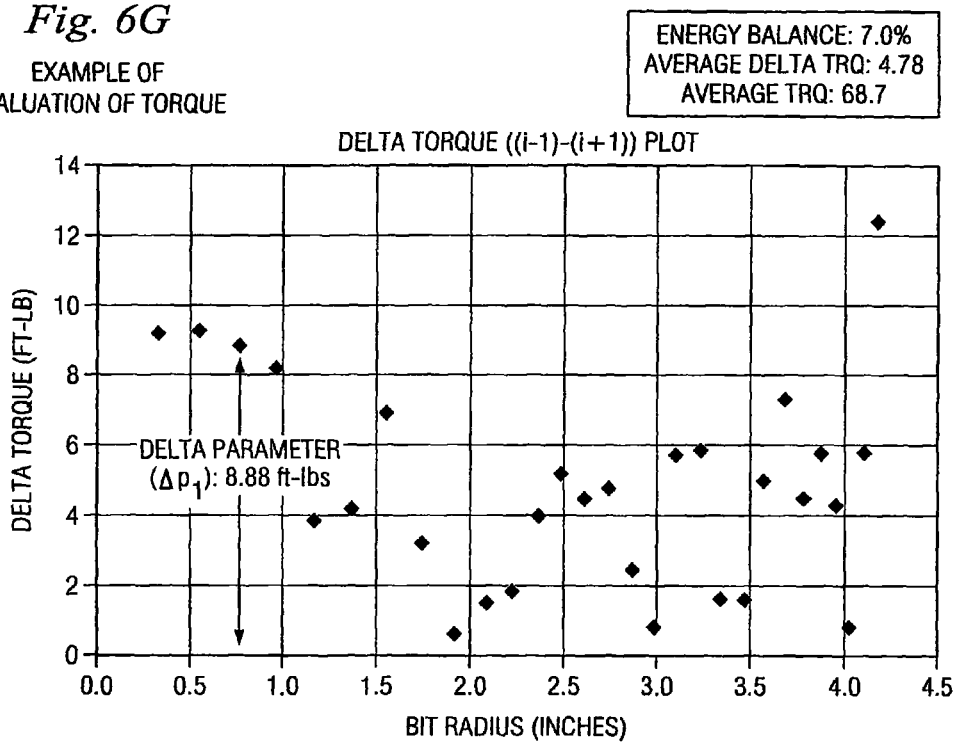
Figure 6H:
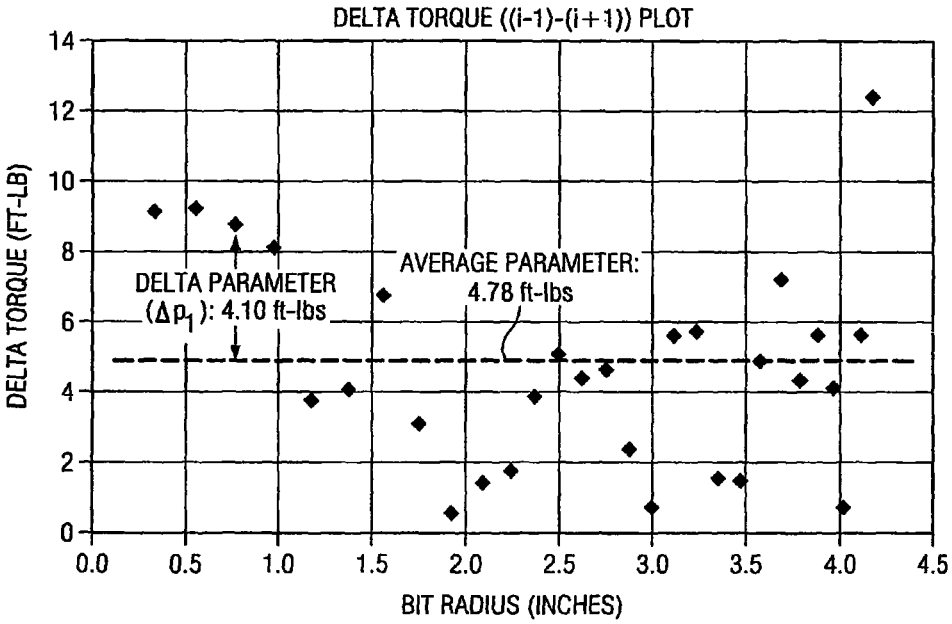
Figure 6I:
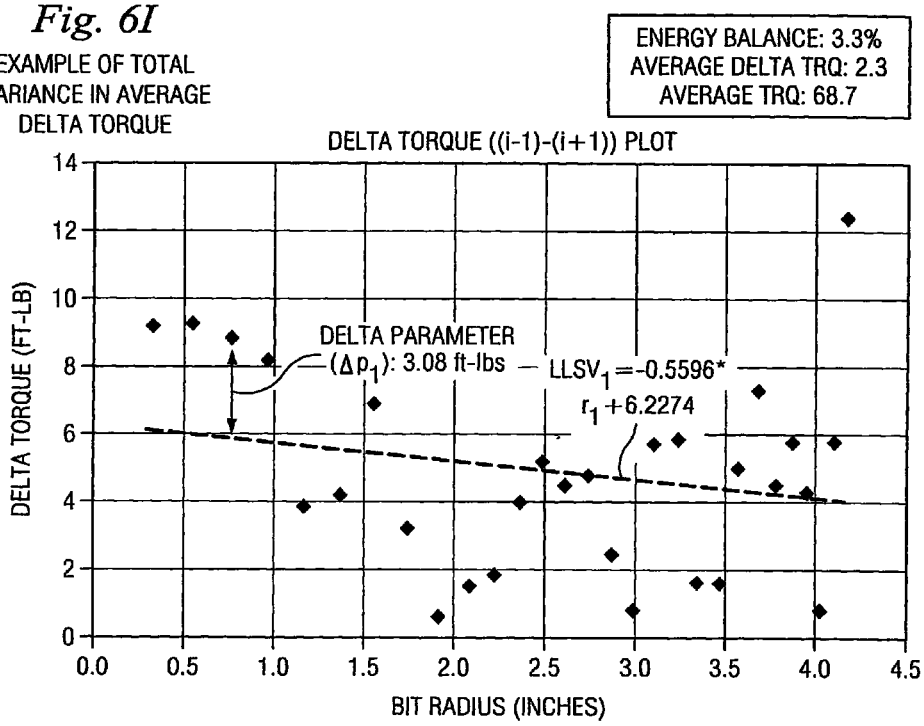
Figure 6J:
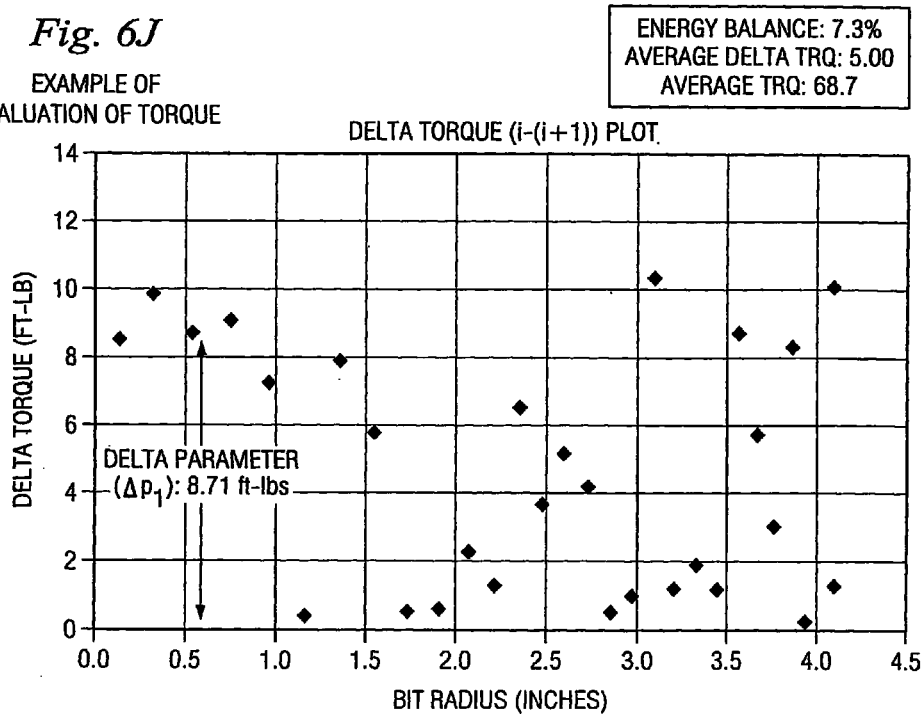
Figure 6K:
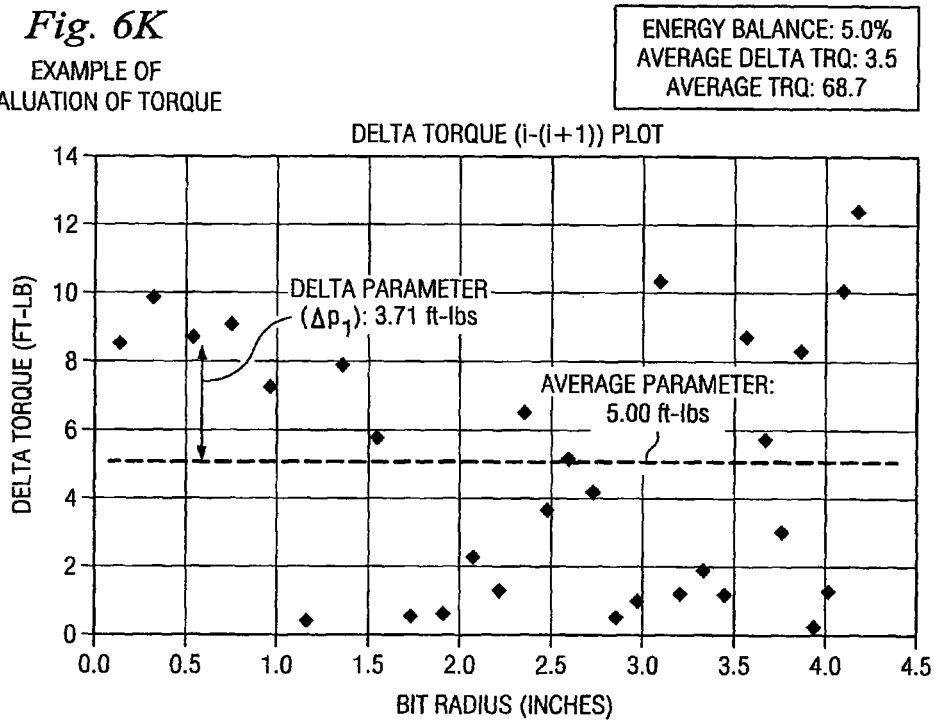
Figure 6L:
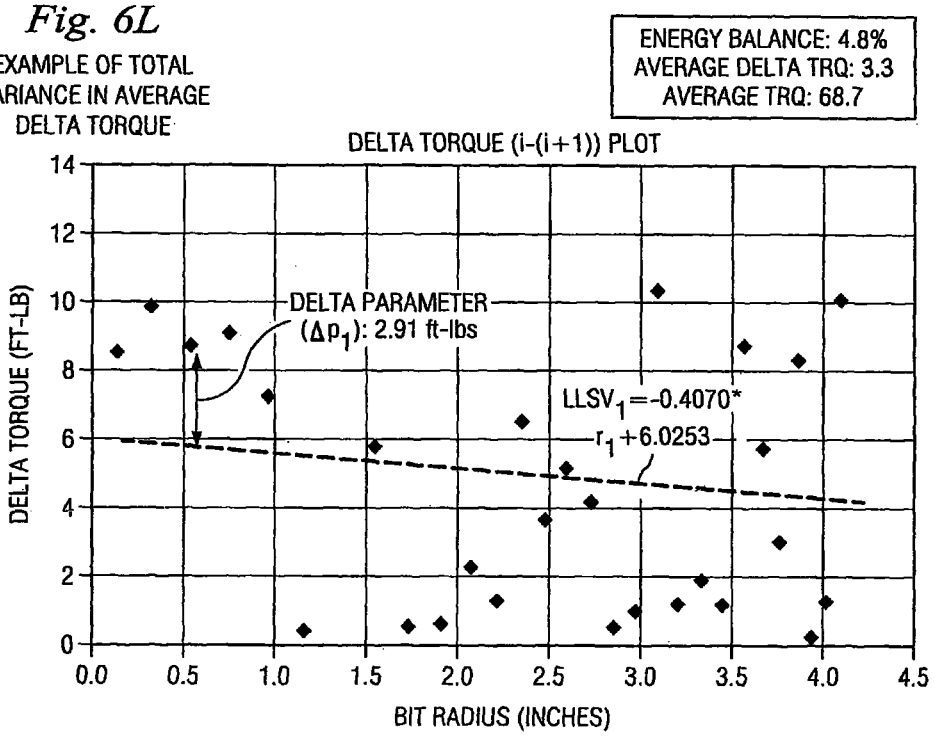

Referring also to FIG. 6E, there is illustrated a representative plot of the average change in parameter per cutter for the radially trailing cutter versus bit radius including variance and standard deviation information (step 626).

In FIGS. 6A-6B, acceptability of the distribution variances is determined (step 320) utilizing the distribution criteria. If not acceptable, the cutting structure is manipulated (step 310) in a manner previously discussed to generate a modified bit design. The design evaluation processes (or selected ones thereof) and necessary design modifications are repeated until acceptability is reached. If acceptable, a final bit design is provided (step 322). The final bit design may be utilized to manufacture a corresponding drill bit.

While not shown in FIGS. 6A-6B, another criterion that may be considered in addition to individual cutter force, work, torque, or power distribution criteria is the total lateral bit moment. An acceptable criterion in one example is a total lateral bit moment imbalance of less than four percent (4%) of the torque on bit. In determining whether the characteristics of the bit being designed meet this criterion, total lateral moment torque for the bit is defined as a torque that tends to rotate the bit about the X and Y axis. Total bit moment is calculated by first determining the force magnitudes ($F_X$, $F_Y$ & $F_Z$) and force locations ($R_X$, $R_Y$ & $R_Z$) on each cutter using the kinematics force model. The cross product of the position vector, R and the force vector F gives the moment vector M ($M_X$, $M_Y$ & $M_Z$). The moment along the z-axis is the bit torque and the moments about the x-axis and y-axis are components of the total lateral moment torque. Total lateral bit moment imbalance is calculated by dividing the total lateral moment torque by the bit torque and multiplying by 100.

In implementing the processes 600 or 600B, it is understood that the force, torque, work, or power distribution criteria may be applied to a single blade of cutters, such that the radial adjacent cutter would then be defined per blade instead of for the whole bit. A region would then be defined as a blade. A region may otherwise be defined as a quadrant of the bit, the face of the bit, the entire bit, or other area. The process may be applied to radially adjacent or alternatively physically adjacent or based on profile component or other basis.

Set forth below is an example of the manner in which the cutter parameter distribution calculations may be performed to "energy balance" a bit:

Energy Balance [Cutter Parameter Distribution] Calculation:

1. Calculate Average Parameter $$A=S/N$$

a. A is the average parameter
b. S is the sum of the parameter for each cutter
c. N is the number of cutters with non-zero values 2. Calculate Standard Deviation for a Parameter $$Stdev=\sqrt{\frac{N\times\sum P^2-(\sum P)^2}{N\times(N-1)}}$$

a. stdev is the standard deviation of the parameter
b. p is the parameter
c. n is the number of patents 3. Calculate the Percent Imbalance $$PEB=\frac{Stdev}{A}$$

a. PEB is the percent energy balance

4. Change in Parameter from Radially Trailing to Leading Cutter $$Chtrq_i=\frac{\|(op2-op)\|+\|(op1-op)\|}{2}$$

a. Chtrq is the change in parameter
b. op2 is the trailing parameter
c. op is the current parameter
d. op1 is the leading parameter 5. Change in Parameter from Radially Trailing to Current Cutter $$Chtrq=\|(op1-op)\|$$

a. Chtrq is the change in parameter
b. op1 is the trailing parameter
c. op is the current parameter Alternative Energy Balance Calculation (FIG. 6B):

6. Change in Parameter from Radially Trailing to Leading Cutter $$Chtrq_i=\frac{\|(op_{i+1}-op_i)\|+\|(op_{i-1}-op_i)\|}{2}$$

a. Chtrq is the change in parameter
b. op is parameter

7. Change in Parameter from Current to Leading Cutter $$Chtrq_i=\|(op_{i+1}-op_i)\|$$

a. Chtrq is the change in parameter
b. op is the parameter

8. Calculate Delta p Using One of Three Methods:

a. Delta p equals Chtrq as defined in 6 or 7

$$\Delta p_i=\mathrm{Chtrq}_i$$

i. Delta p is the delta parameter
ii. Chtrq as defined in 6 or 7 b. Delta p equals the difference between the average difference and the actual difference i. Calculate average change in parameter $$AChtrq=\frac{\sum Chtrq_i}{N}$$

1. Chtrq as defined in 6 or 7
2. N is number of non zero parameters
3. AChtrq is the average change in parameter ii. Calculate delta p for each non zero parameter cutter $$\Delta p_i=AChtrq-Chtrq_i$$

1. AChtrq is the average change in parameter
2. Chtrq as defined in 6 or 7
3. delta p is the delta parameter c. Delta p equals the difference between the linear least squares difference and the actual difference i. Calculate slope and intercept of linear least squares fit $$b=\frac{\sum Chtrq_i*\sum r_i^2-\sum r_i\sum r_i*Chtrq_i}{N*\sum r_i^2-(\sum r_i)^2}$$

$$m=\frac{N*\sum Chtrq_i*r_i-\sum Chtrq_i*\sum r_i}{N*\sum r_i^2-(\sum r_i)^2}$$

1. N is the number of non zero parameters
2. Chtrq as defined in 6 or 7
3. r is the radial position on the non zero parameter
4. b is the intercept of the linear least squares fit
5. m is the slope of the linear least squares fit ii. Calculate linear least squares values for each non zero parameter $$\mathrm{LLSV}_i=m*r_i+b$$

1. r is the radial position on the non zero parameter
2. b is the intercept of the linear least squares fit
3. m is the slope of the linear least squares fit
4. LLSV is the linear least square value iii. Calculate delta p for each non zero parameter cutter $$\Delta p_i = LLSV_i - Chtrq_i$$

1. LLSV is the linear least square value
2. Chtrq as defined in 6 or 7
3. delta p is the delta parameter 9. Calculate Average Delta Parameter $$ADP = \frac{\sum \Delta p_i}{N}$$

a. ADP is the average delta parameter
b. Delta p is the delta parameter as defined in 8a or 8b or 8c
c. N is the number of non zero parameter cutters 10. Calculate Average Parameter $$A = S/N$$

a. A is the average parameter
b. S is the sum of the parameter for each cutter
c. N is the number of cutters with non-zero values 11. Calculate the Percent Imbalance $$PEB = \frac{ABP}{A} * 100$$

a. PEB is the percent energy balance
b. ADP is the average delta parameter
c. A is the average parameter Bit Design Process Example FIGS. 7-13 illustrate an example application of the bit design process to produce a bit design in accordance with the wear value, force balance, moment balance, and force distribution criteria described herein.

Figure 7A:
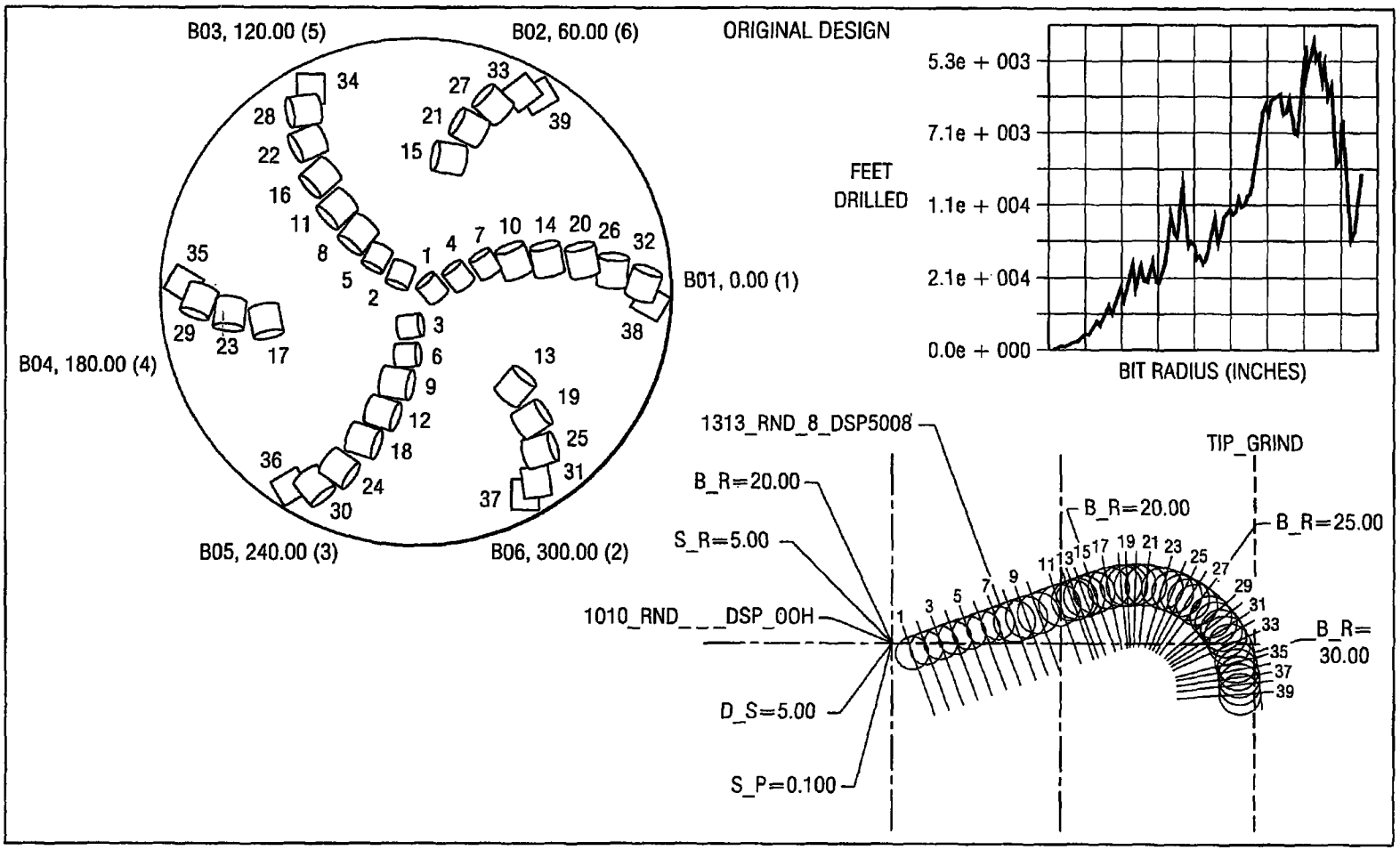
Figure 7B:
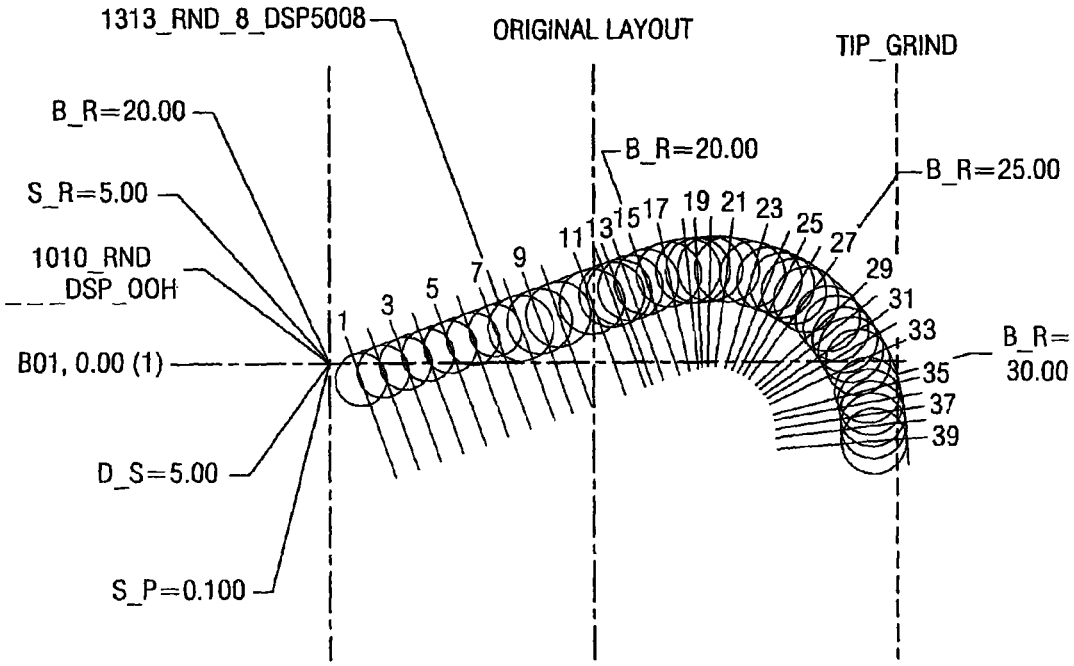

An original cutting structure design is created based on standard design principles (FIGS. 7A-7B). In this example, the application need dictates a bit design comprising a 8.5 inch diameter; six cutter blades; relatively short profile; variable back rake (20; 15; 20; 25; 30 degrees); 5 degree side rake; 5 degree per cutter spiral; a minimized cutter spacing; and ten millimeter cutters in the center continuing with thirteen millimeter cutters.

The graphical display of FIGS. 7A-B show a plan view of the face of the cutter structure with references indicating cutter blade number and degree of blade, and including cutter text numbering of the cutters radially. A profile view of the cutter is also shown with tags indicating cutter layout zones that define cutter locations, back rakes, side rakes, and spacing.

Wear value, force balance, and force distribution calculations are performed on the original design to produce corresponding graphical displays (FIGS. 7C-7H).

The force balance calculations performed for the original design (FIG. 7D) are presented as a table. Identified are default parameter inputs (ROP; RPM; Rock Strength; and Hours of Drill) for a simulated test, and the analysis results (i.e., bit imbalance, WOB, TOB, and bit engagement areas). The analysis results pertaining to bit imbalance show a direction value of the Result vector (total imbalance force) of 320.6717 degrees, which is 8.6336 percent of the total load (WOB) of 15863.2631 lbs. The corresponding radial and drag components are likewise identified. Also shown is the direction value of the total lateral moment vector (total lateral bit moment imbalance), which is 12.1910 percent of the 2067.7217 TOB.

The results of the force distribution calculations performed on the original design are also presented graphically (FIGS. 7E-7H). For example, the original torque distribution graph (FIG. 7E) shows the torque on each cutter radially for each blade (blades #1-#6). The results are an uneven distribution of torque for each cutter across the radius of the bit, with a total variance in torque of 26.1% ("Energy Balance 26.1%").

Figure 7C:
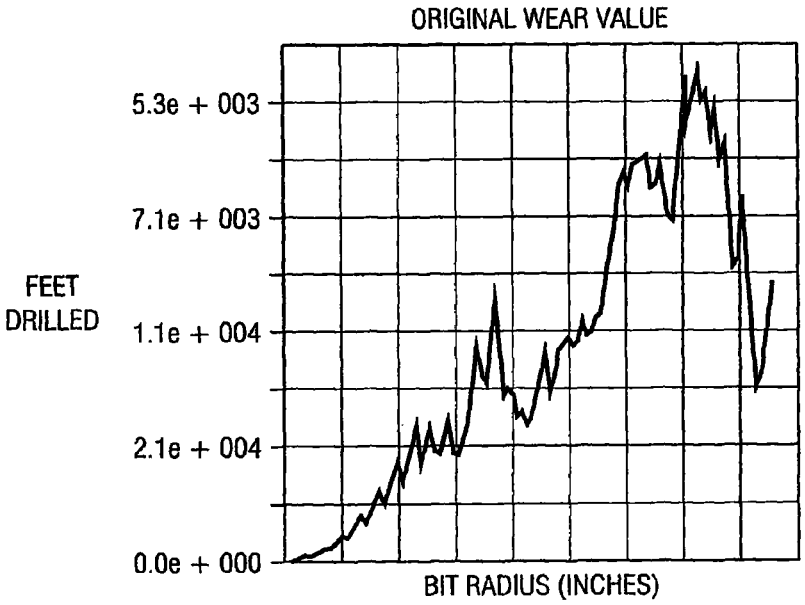
Figure 7D:
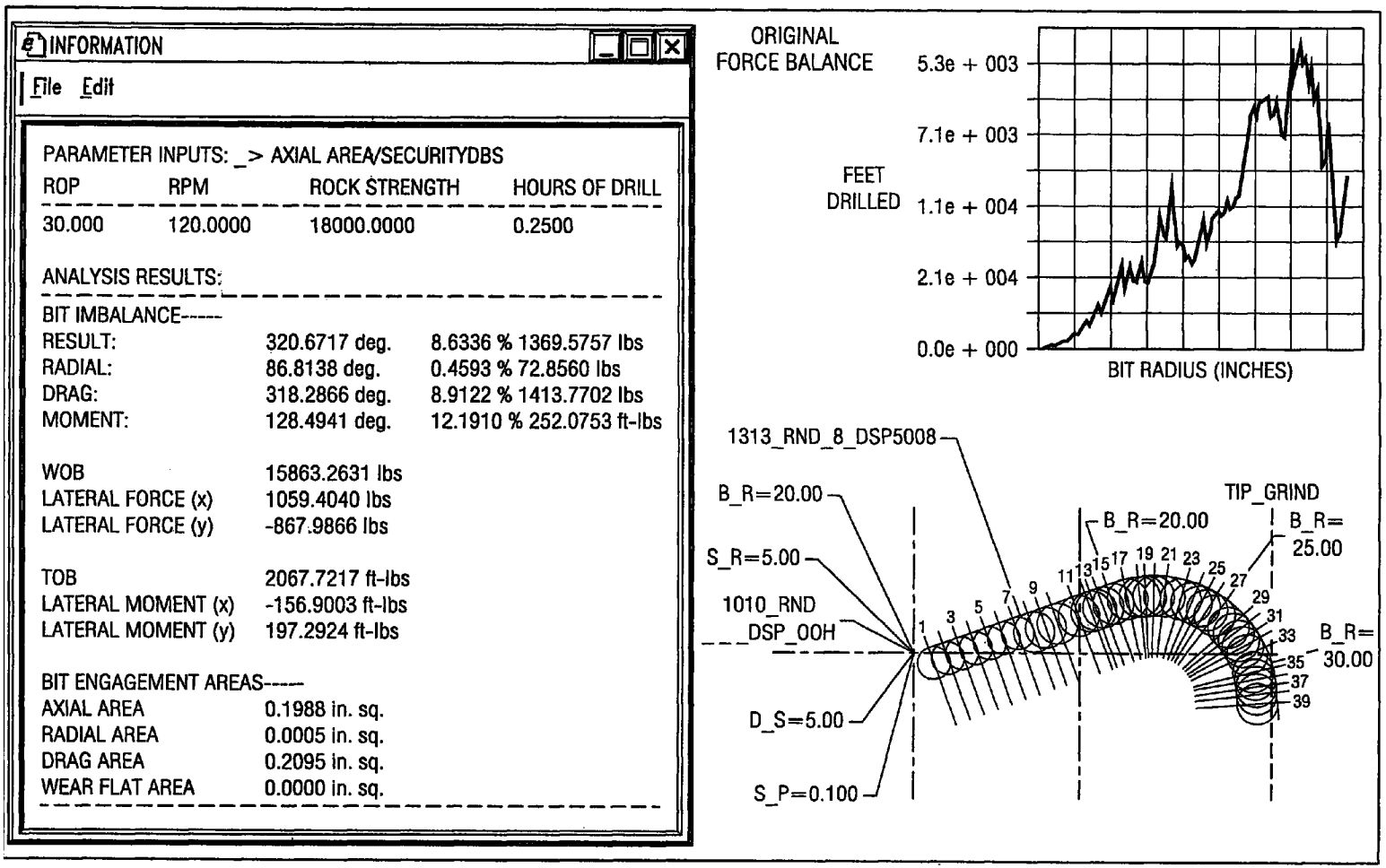
Figure 7E:
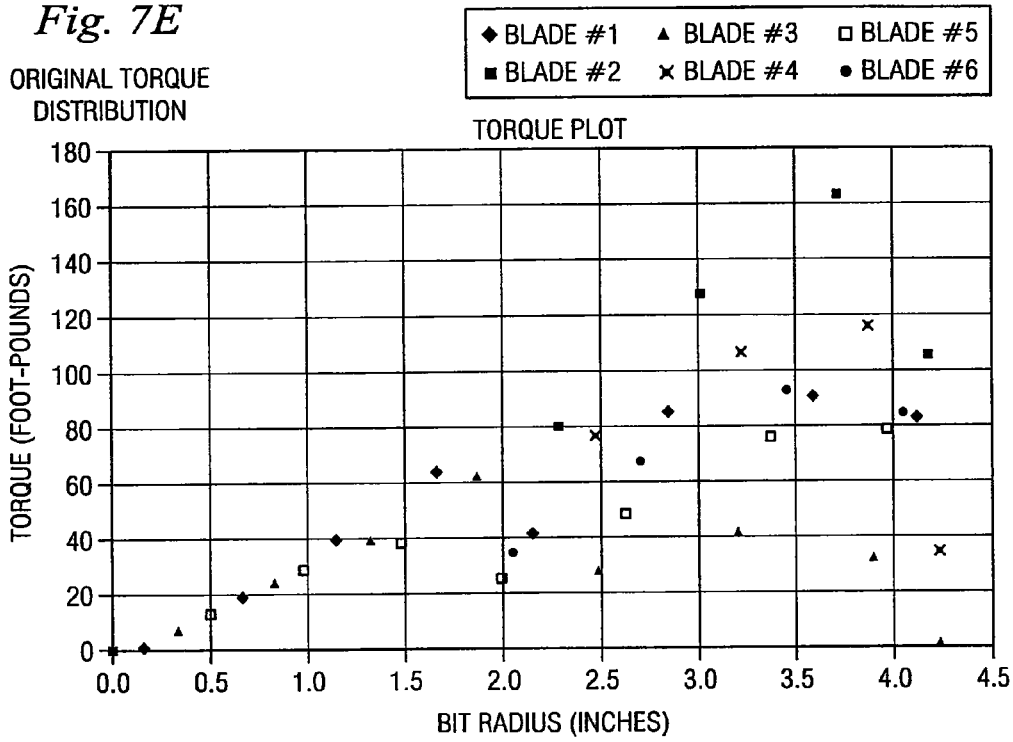
Figure 7F:
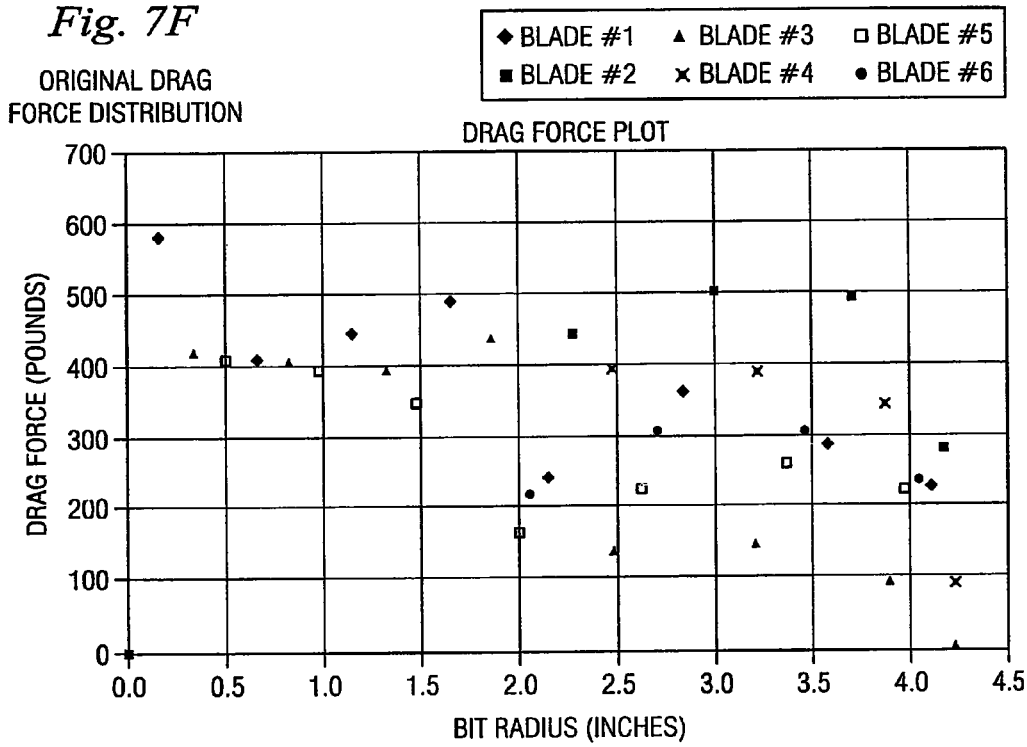
Figure 7G:
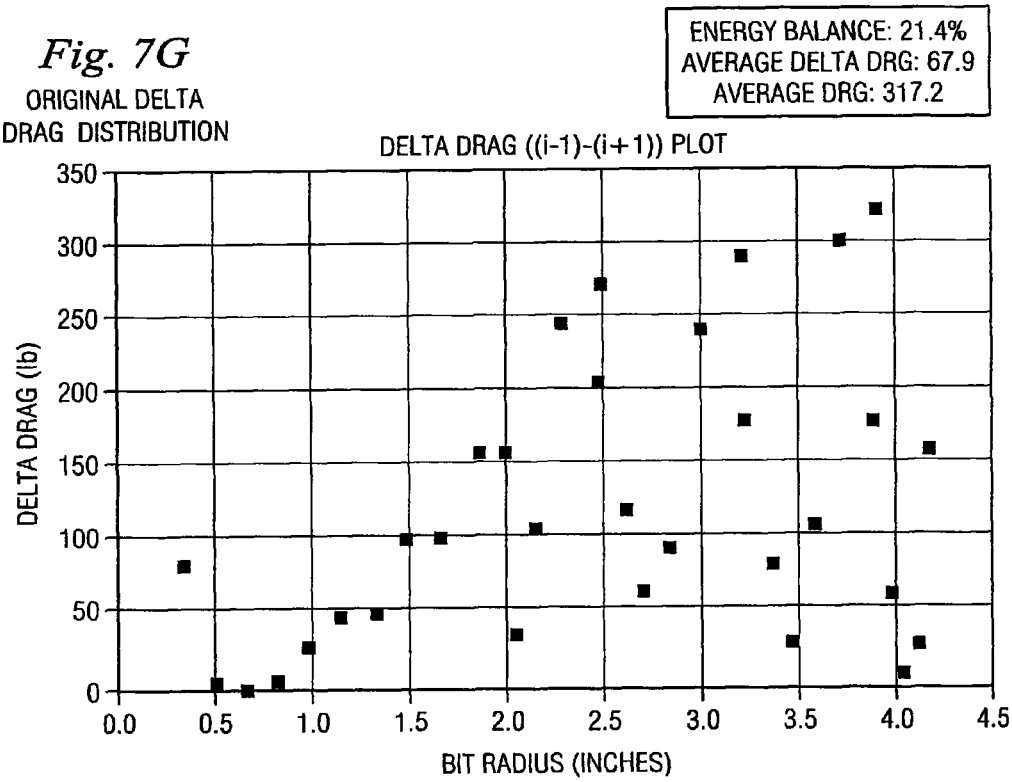
Figure 7H:
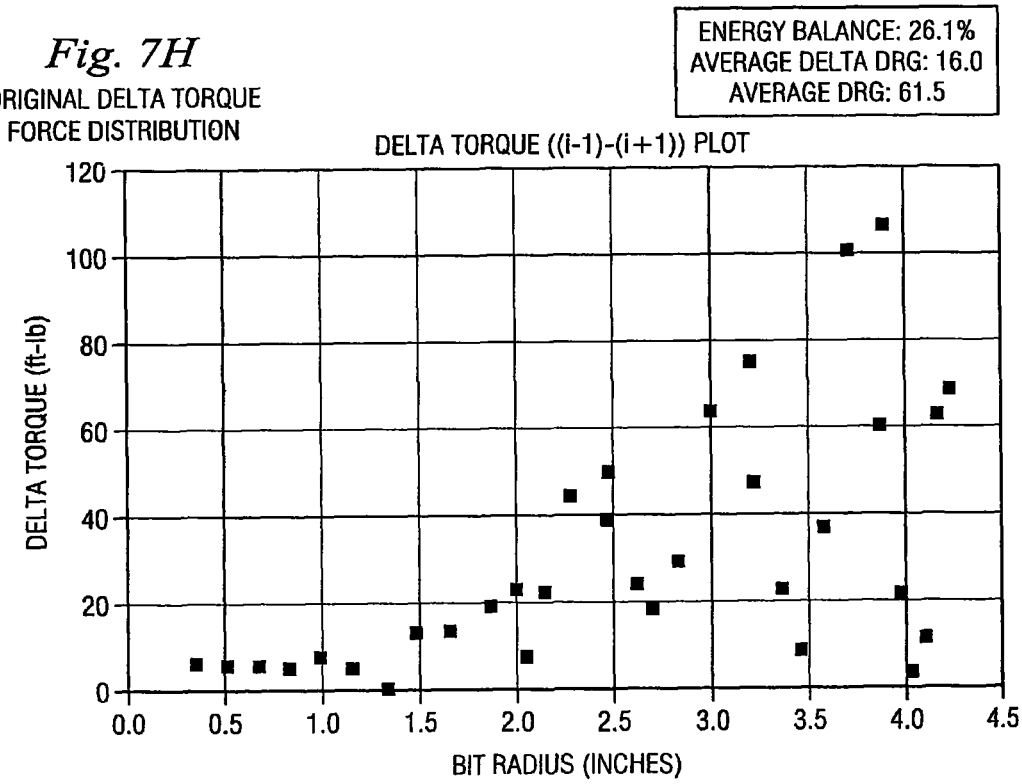
Figure 8A:
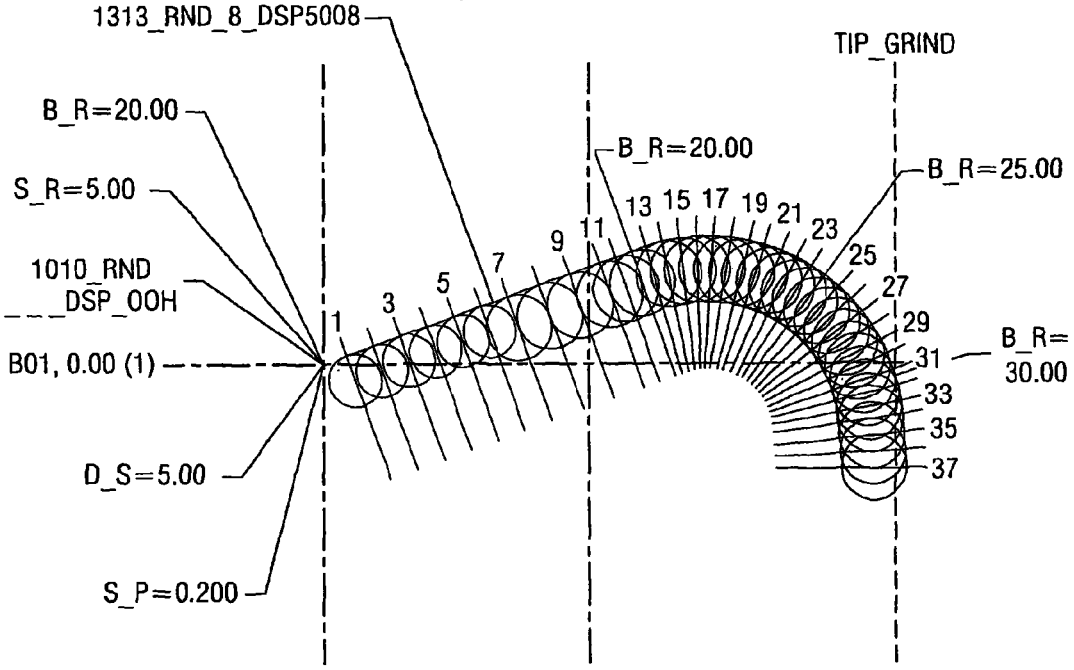
Figure 8B:
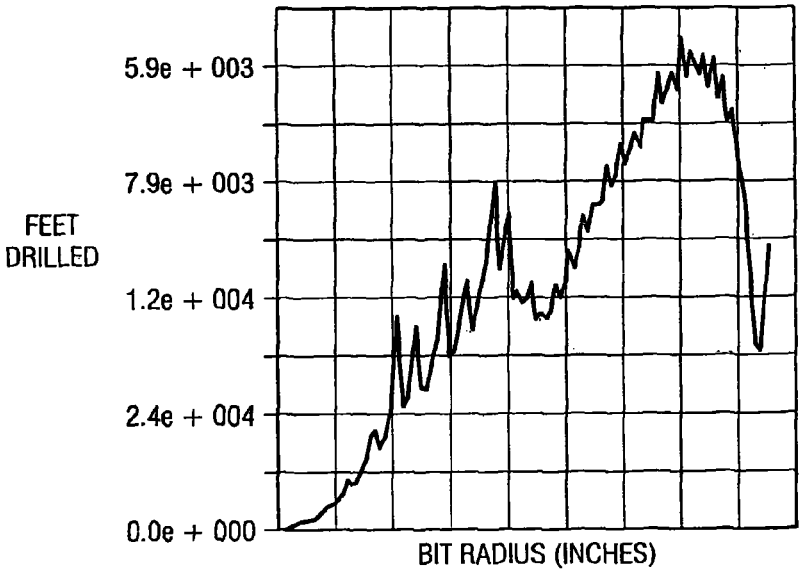

Furthermore, analysis of the graphical displays suggests that the original cutter spacing of 0.100 inches has caused an irregular pattern of cutter spacing, creating spikes in the wear value (FIG. 7C).

A design change is therefore made so that the cutter spacing is altered to 0.200 inches (modified design #1). This provides for a more regular cutter spacing to be generated by the modeling program, as indicated by the new layout illustrated in FIG. 8A. Wear value calculations are performed for the modified design #1, with the resulting wear value graph, FIG. 8B, indicating an acceptable wear value curve for the modified design.

A new force balance calculation is performed for the modified design #1, the results being illustrated in FIG. 8C. While the changed cutter spacing improved the force balance of the bit (to 5.5642%), the force balance indicated does not conform to desired standards.

Figure 9A:
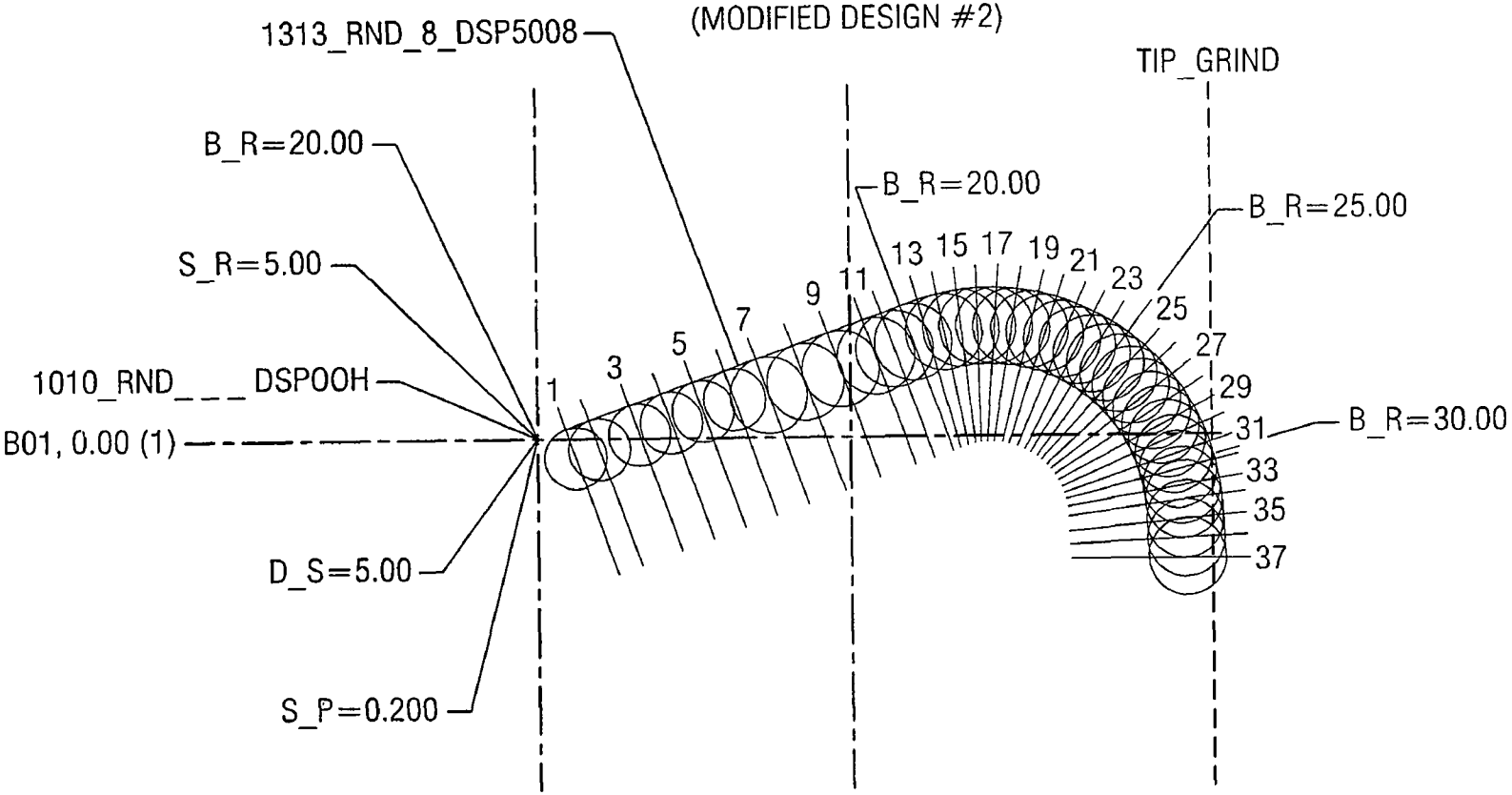

Accordingly, as illustrated in FIG. 9A, another design change is made wherein the cutters #2 and #3 are moved toward the bit center to increase the force balance (modified design #2). This change is made in view of the fact that cutters close to the center do not typically adversely affect bit wear.

FIG. 9B shows the new force balance calculation for the modified design #2. While the force and moment balances are improved (5.3163% and 5.3472%, respectively), they still do not meet the design standard.

Figure 10A:
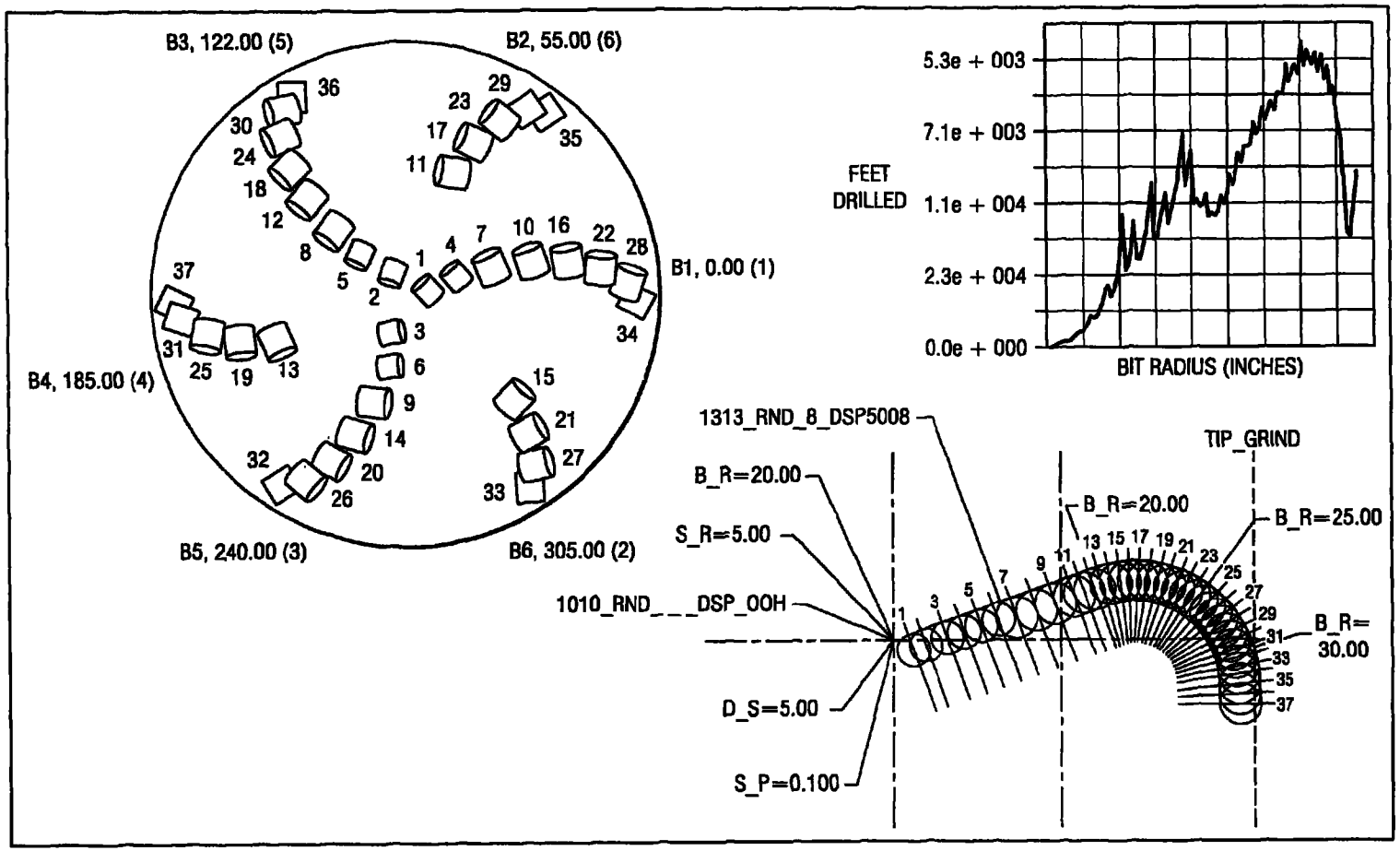
Figure 10C:
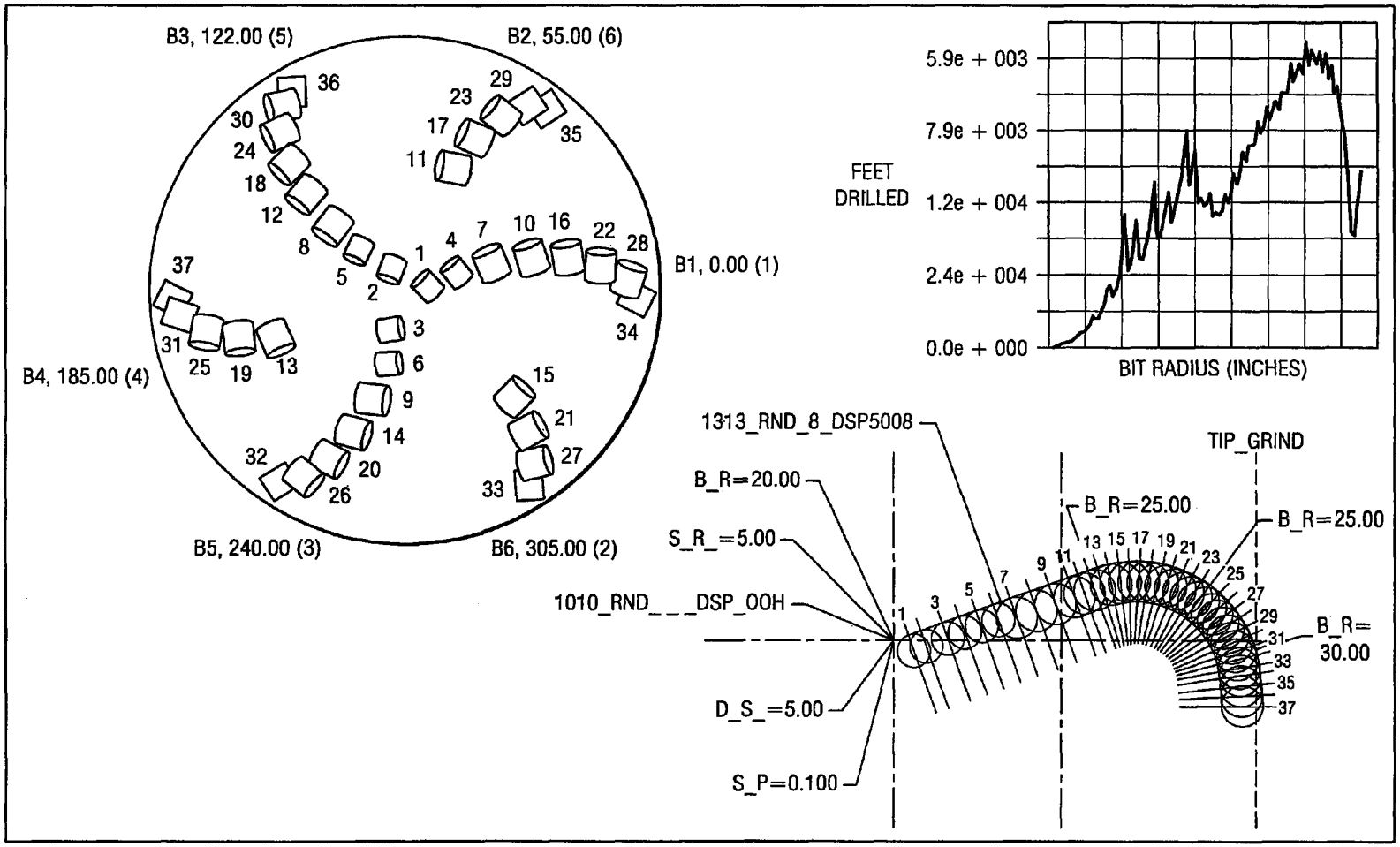

Referring to FIG. 10A, yet another design change is made wherein the blade positions of the #2, #3, #4, and #6 blades are changed (modified design #3). As shown in FIGS. 10B-10C, this produces a modified design #3 that conforms to acceptable wear value and force balance criteria. Additionally, it introduces asymmetrical blades.

Reviewing the original energy balance graphs (FIGS. 7E-7H), a large change in torque occurs through the transition from three to six blades. The irregular cutter spacing has caused rather large fluctuations in parameters.

Figure 11A:
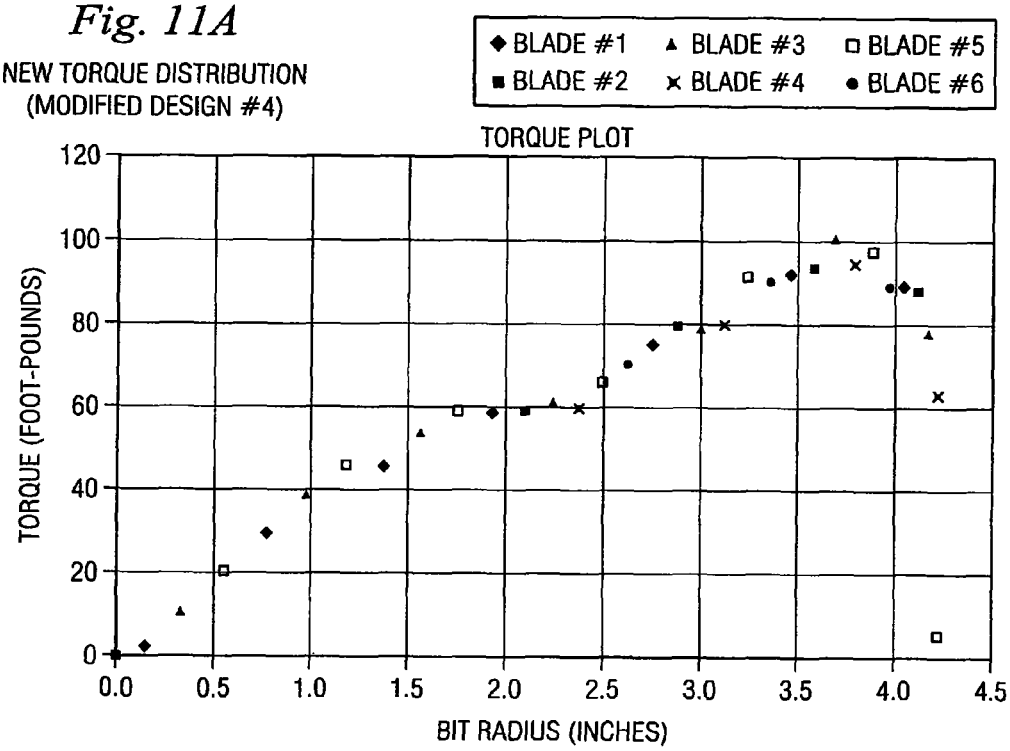
Figure 11B:
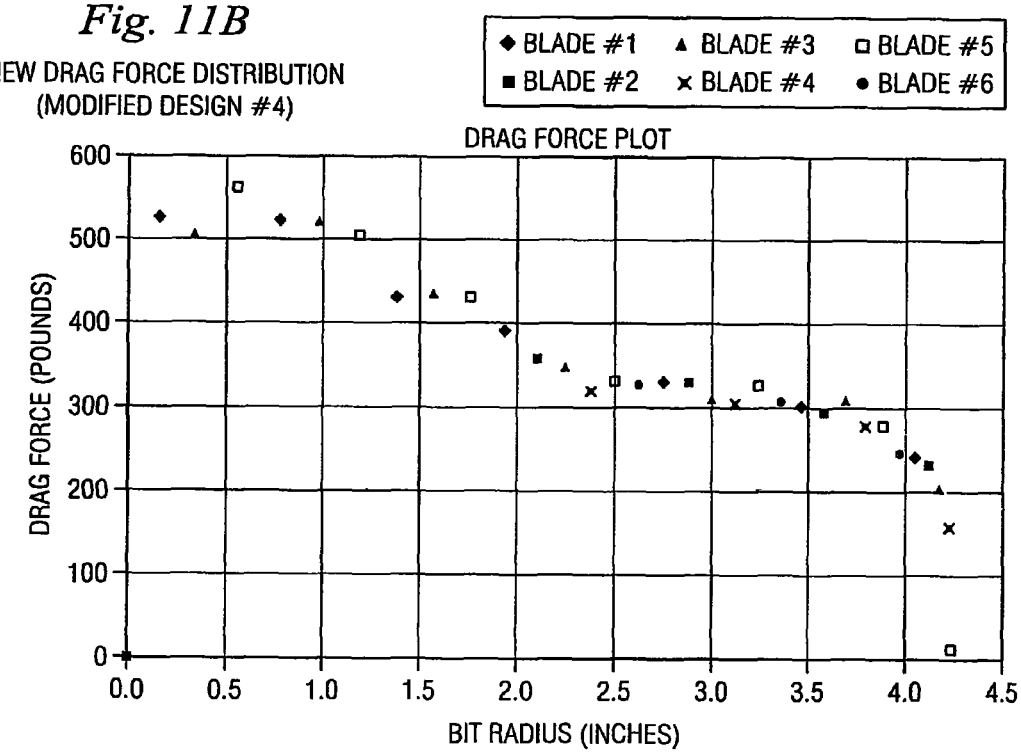
Figure 11C:
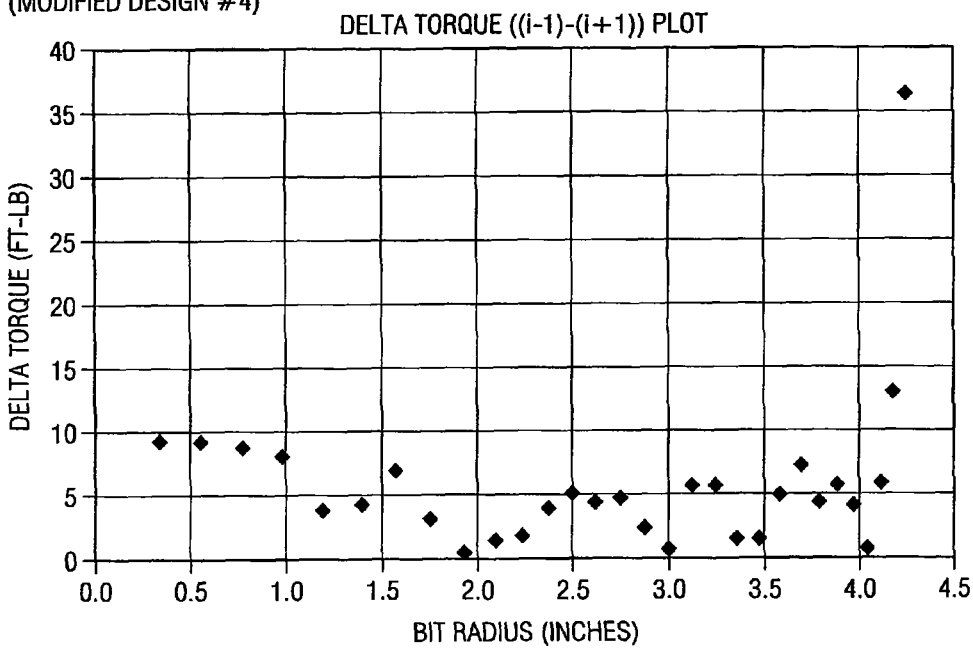
Figure 11D:
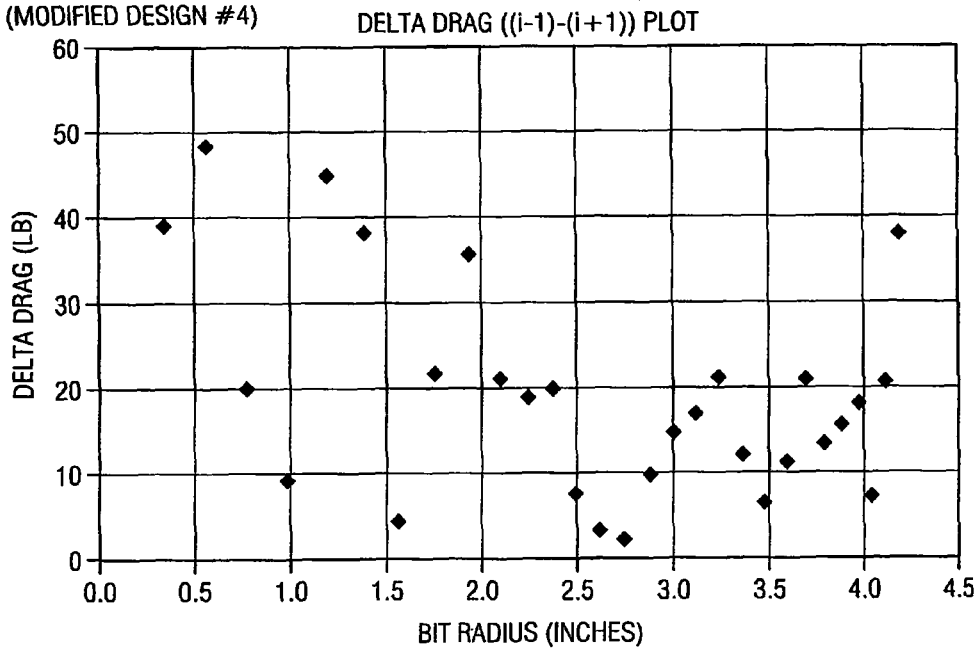
Figure 11E:
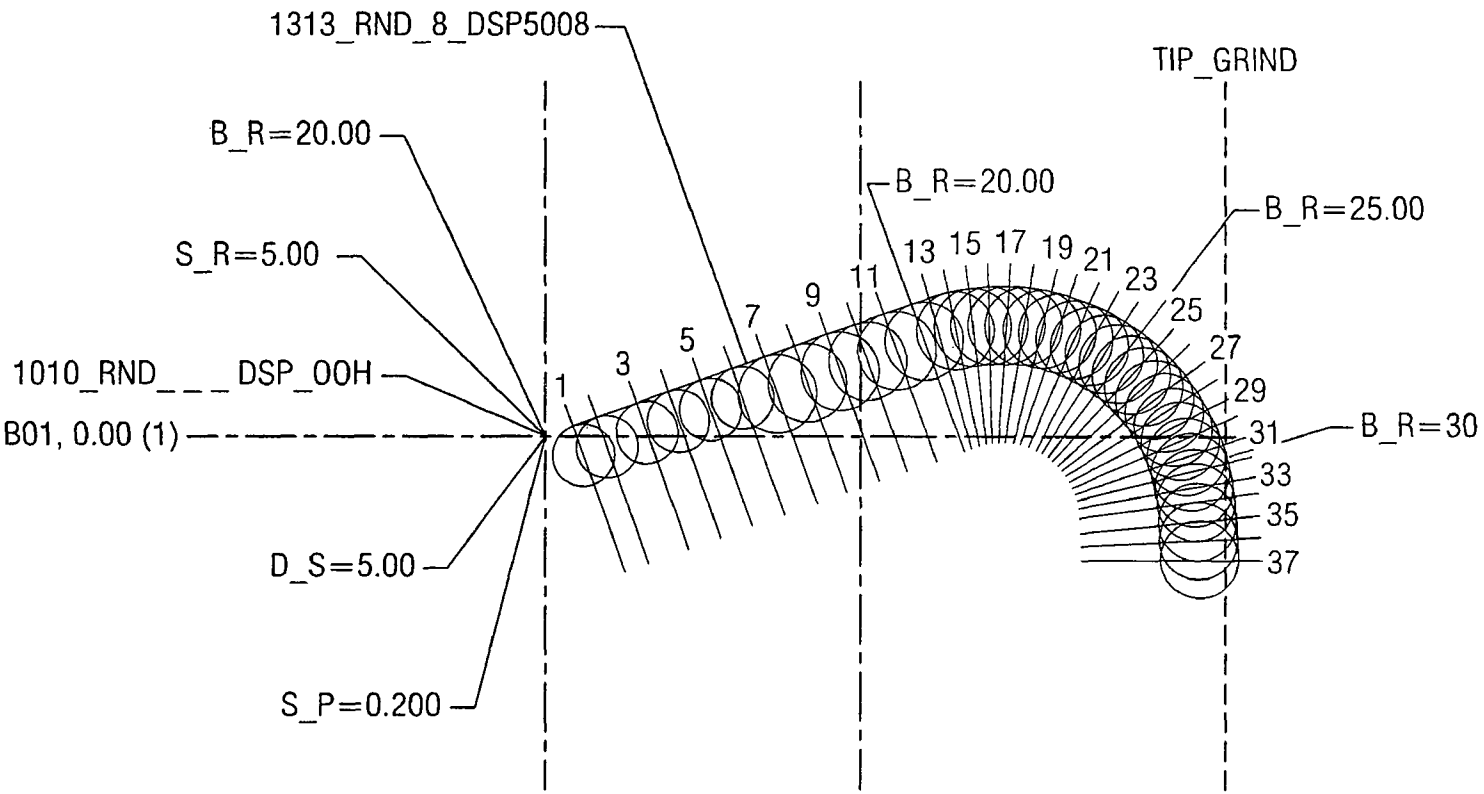

Accordingly, a design change is made wherein the cutter spacing of cutters #8, #9, #10, #11, and #12 are adjusted in the transition zone (modified design #4). This more evenly distributes the forces through the transition between primary and secondary blades. With reference to FIGS. 11A-11D, modified design #4 demonstrates an improvement in distribution of forces and other parameters and a reduction in the variance thereof from cutter to cutter. As shown in FIG. 11E, an acceptable energy balanced cutter profile is produced.

Figure 12:
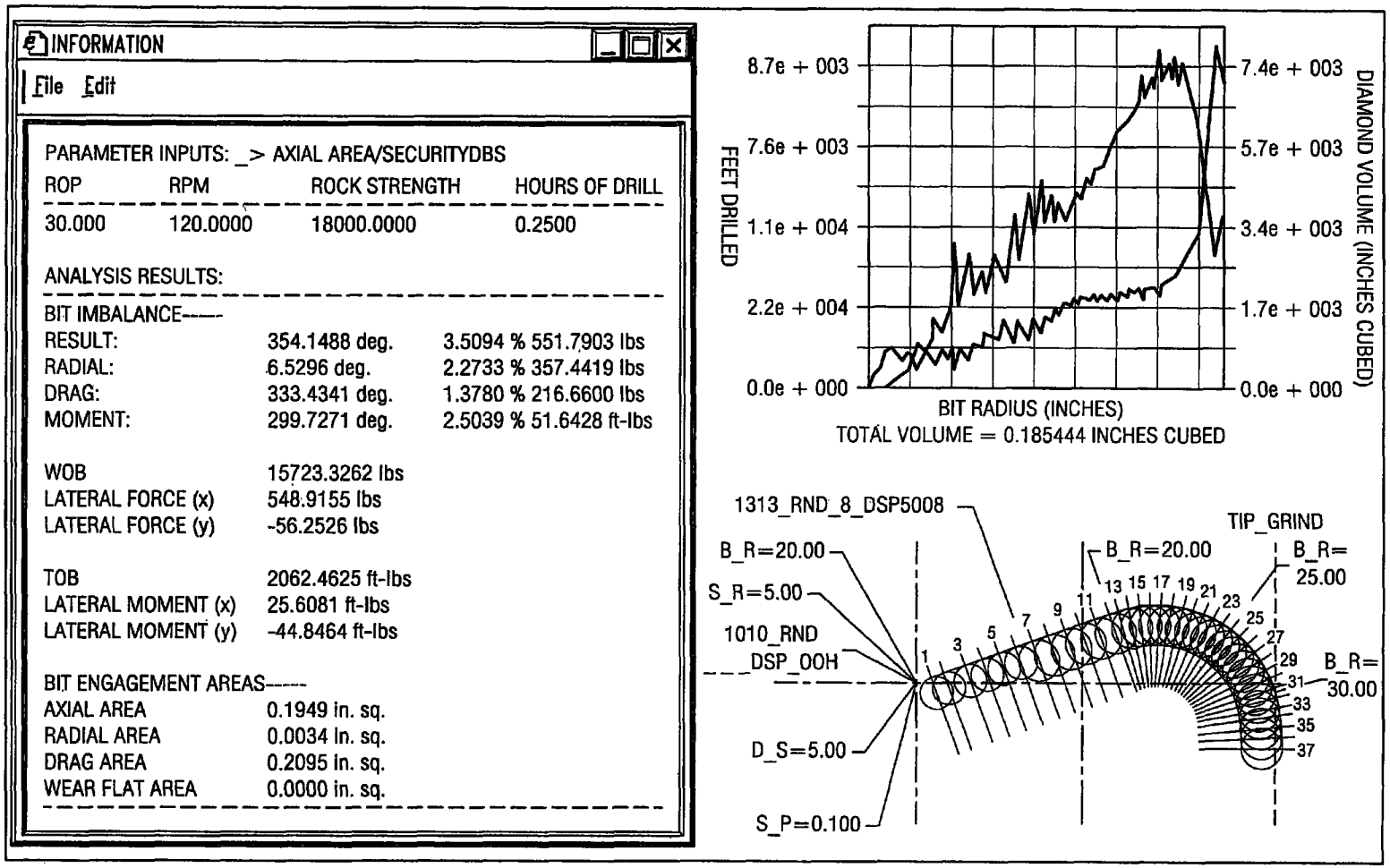
Figure 13A:
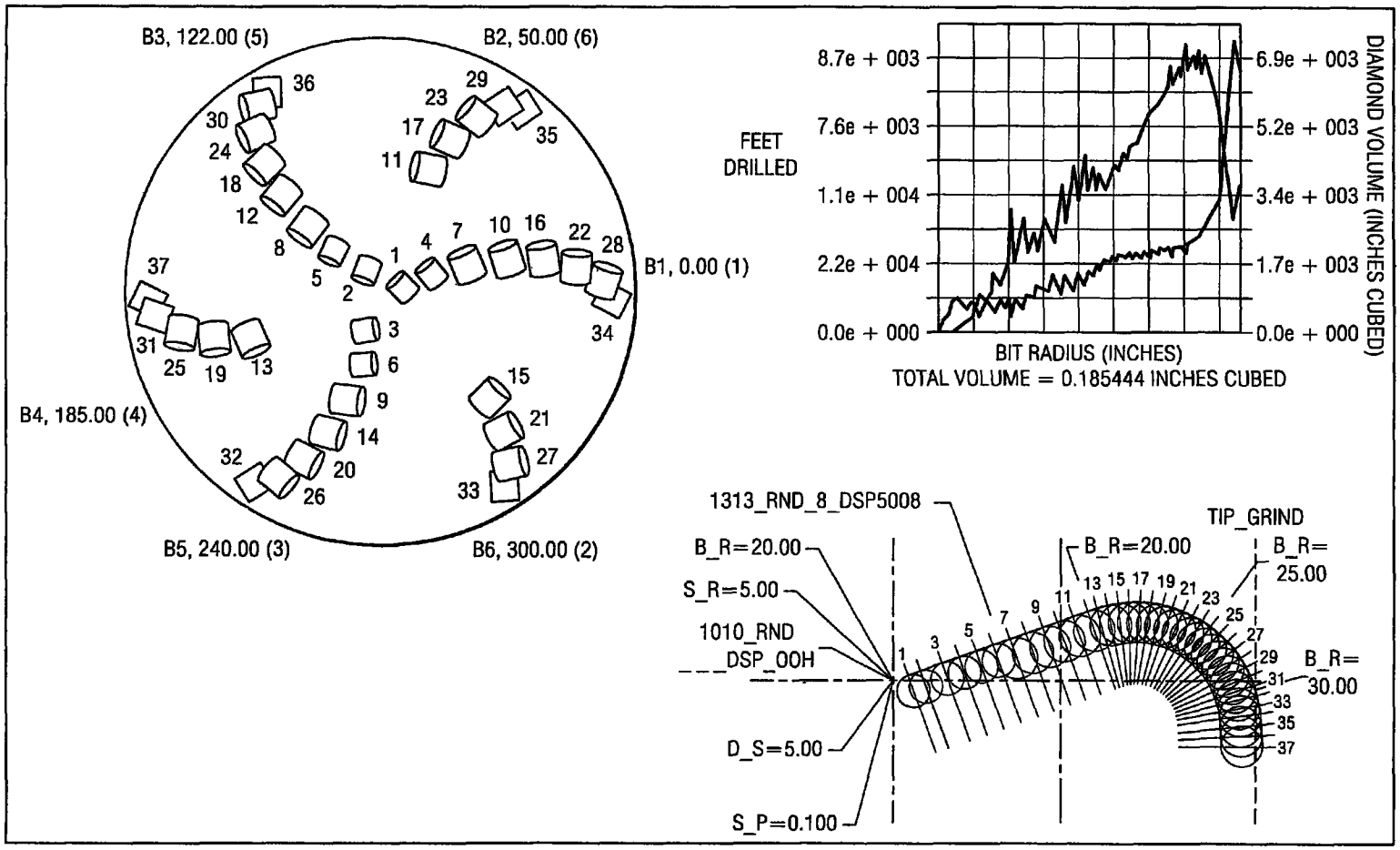
Figure 13C:
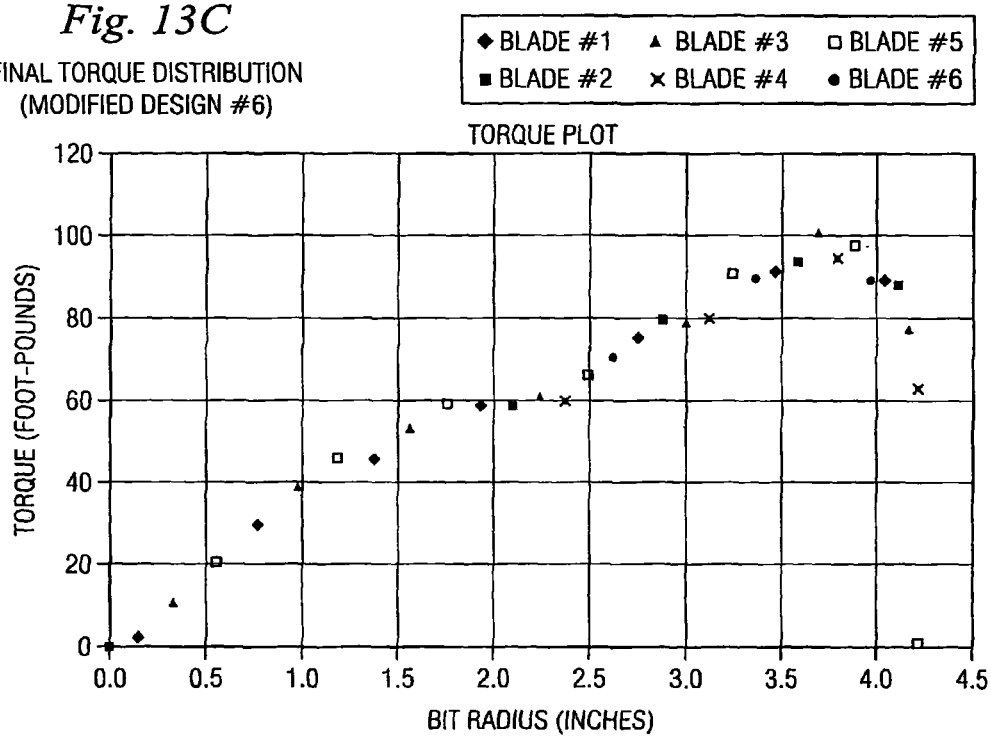
Figure 13D:
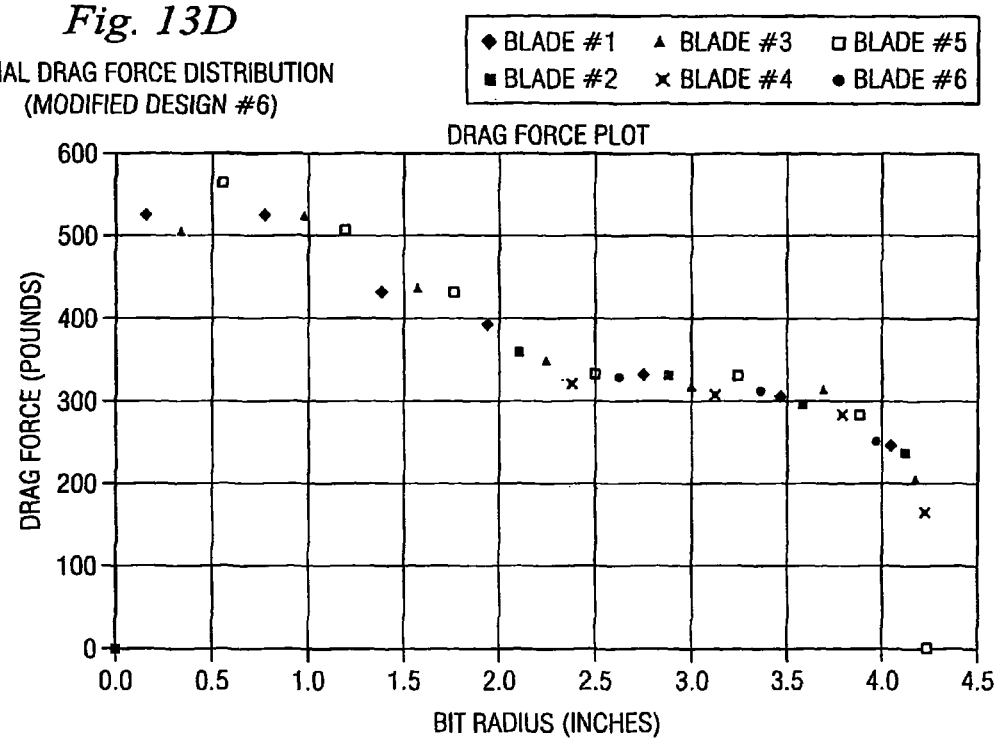
Figure 13E:
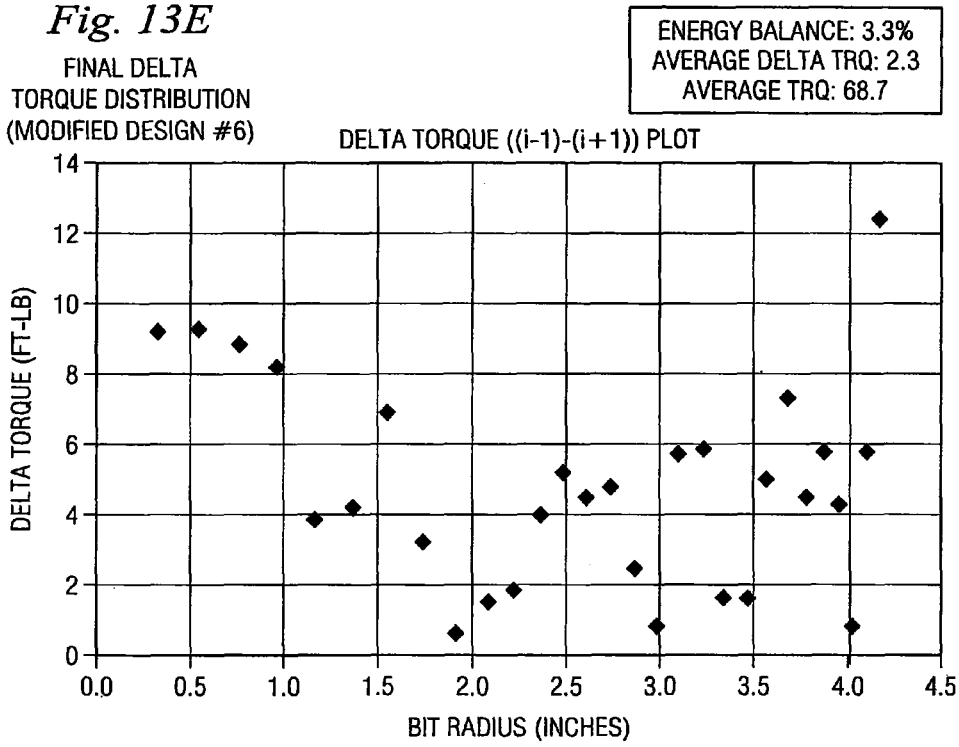
Figure 13F:
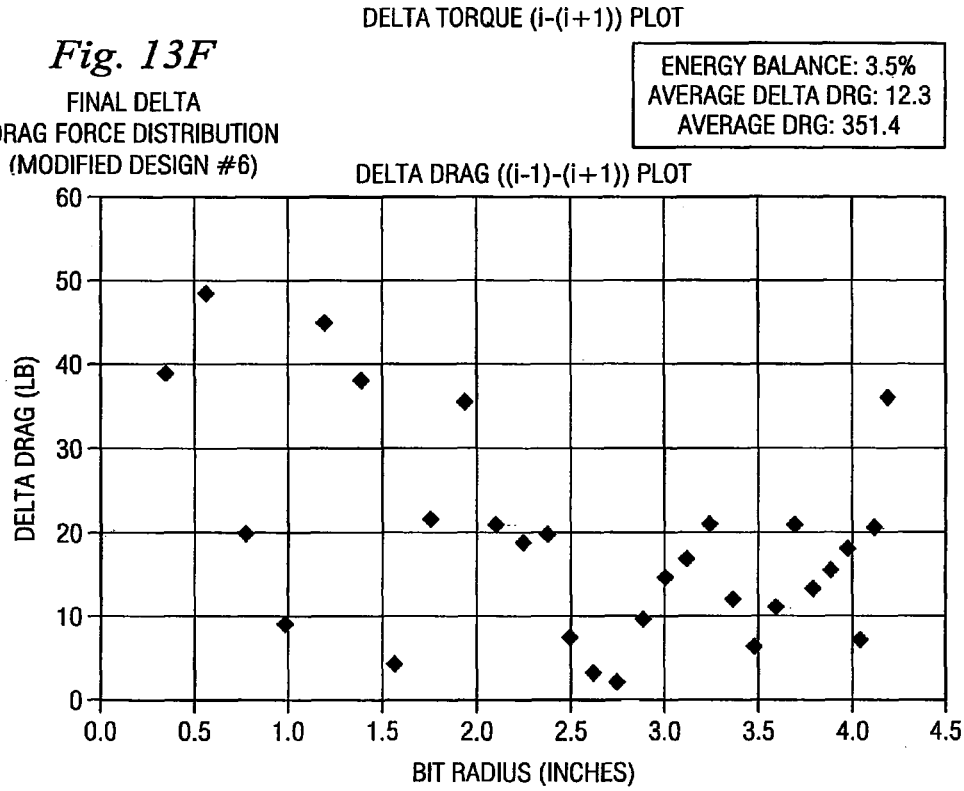

While energy balance is improved with design change #4, the force balance is no longer within design limits. Accordingly, a design change is made in which blades #2 and #3 are moved along with cutter #2 to achieve a new force balance (modified design #5). FIG. 12 illustrates an acceptable force and moment balance for modified design #5.

Modified design #5 improves the force balance but results in energy balance being outside the design criteria. Cutter #32 is moved to achieve a new energy balance (modified design #6). FIGS. 13A-13F illustrate acceptable wear value, force and moment balance, and energy balance (force distribution) characteristics for modified design #6, the final design.

As mentioned above, in implementation of the processes herein it is understood that the force, torque, work, or power distribution criteria may be applied to different regions of the bit. There are various ways in which to divide the cutting structure into regions and apply associated methods of energy balancing.

Figure 14A:
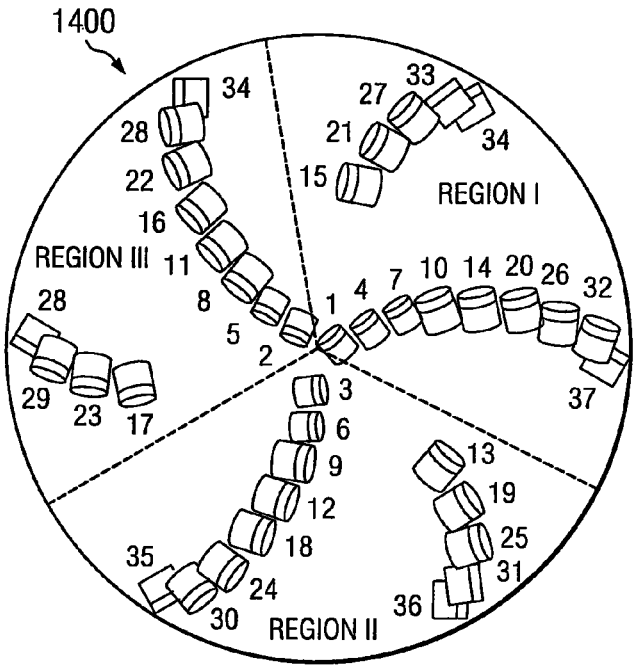
Figure 14B:
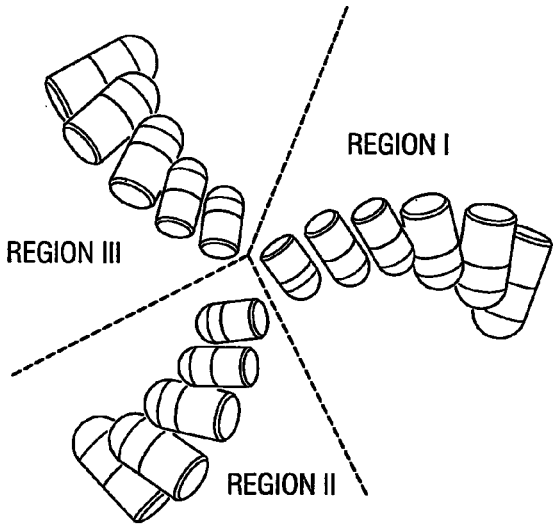

For example, as shown in FIGS. 14A and 14B, a bit face 1400 is conceptually divided into multiple regions. The cutter blade geometries in these regions are not necessarily symmetric. Each region may have different number of cutters, even different number of blades. However, it may be possible to arrange the blades or cutters in each region in such a way that the resultant forces (or cutting volume) in each region are symmetric or close to symmetric. Then the bit forces will be balanced as a direct result of region balancing or by slightly adjusting the angular position of each region. This procedure may be called a two level balancing. The first level is to balance the region forces or cutting volume. The second level is to balance the bit. The two level balancing can make sure the bit is more stable than one level balancing.

Figure 15A:
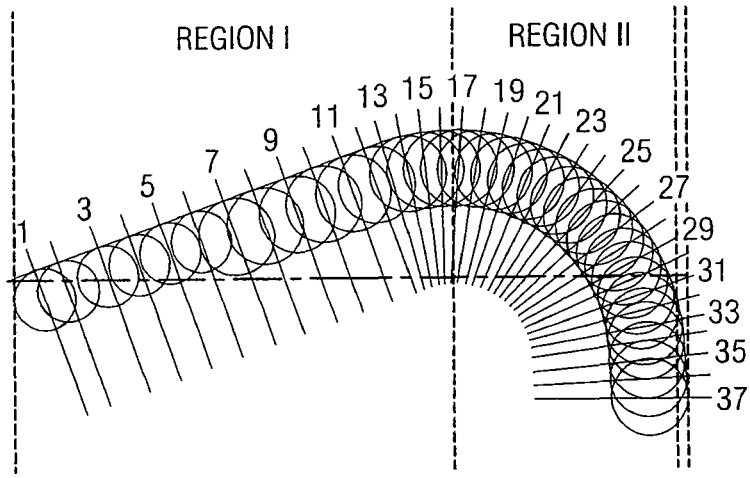
Figure 15B:
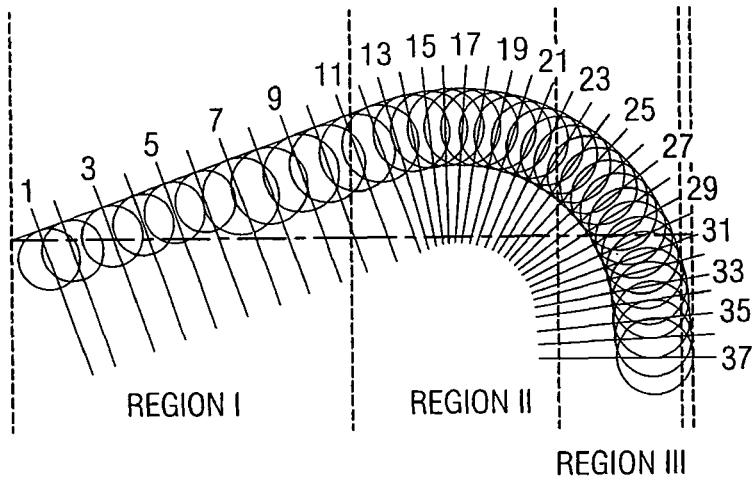

In another example, referring to FIGS. 15A and 15B, a drill bit is shown in cross-axial view and is divided into multiple regions, as represented by a single blade 1500. In FIG. 15A the bit is divided into two parts: cone region and gauge region. The projection of cutter normal force, for example, in the plane perpendicular to bit axis in these two regions may be balanced in a variety of ways in accordance with the present teachings. In FIG. 15B the bit is divided into three parts: cone region, middle region and gauge region. It may be make sense to divide the bit in this way when bit drills from soft to hard formations or from hard to soft formations. In this situation, forces in the middle region may be balanced by forces in the cone and gauge region.

The present design processes allow designers to more accurately define a drill design and thereby control manufacturing costs in addition to enabling improved customization of the drill bit for the customer. Bits can be designed with particular force, torque, work, or power distributions, or combinations thereof, to best accomplish desired performance expectations. This allows designers to more accurately define a drill design and thereby control manufacturing costs in addition to enabling improved customization of the drill bit for the customer combinations thereof, to best accomplish desired performance expectations.

Variations in the processes defined and structures generated are contemplated. For example, ranges of design criteria may be defined differently. Instead of comparisons among trailing and leading cutters, ranges may comprise any two radially adjacent cutters, and three radially adjacent cutters, and so on. Likewise, the cutters do not need to be radially adjacent, but may be otherwise adjacent or near each other. Different calculations may be used to determine parameter distributions for cutters relative to other cutters for drawing meaningful comparisons in the design of a bit. In some examples, such as in the case of directional drilling, it may be desirable to have a particular torque distribution as opposed to a very low total imbalance force. In other examples, it may be desirable to control (not necessarily just lessen, but perhaps increase) variations in the distribution of loads (forces, work, torque, power) among cutters in regions of the bit to accomplish special performance goals. The analytical capabilities embodied here may be utilized to achieve a variety of design goals, in addition to those described in the present examples, consistent with the principles herein. The present principals may also be used with roller cone bits.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A method for designing a fixed cutter drill bit, comprising:

defining a cutting structure for the fixed cutter bit and applying the defined cutting structure to a simulated formation for producing generated values of at least one cutter parameter for the defined cutting structure selected from the group consisting of force, torque, work, and power;

determining whether the generated values of the at least one cutter parameter meet one or more design criteria for optimizing a distribution of generated values for individual cutters relative to other cutters within a region or among regions of the fixed cutter bit; and redefining the cutting structure until the one or more distribution design criteria are met;

wherein the method is implemented utilizing one or more computer programs.

2. The method of claim 1 wherein the one or more distribution design criteria comprises an upper threshold of total variance in an average change in value of the at least one cutter parameter for a cutter and its radially trailing and leading cutters.

3. The method of claim 2 wherein the upper threshold of total variance is less than five percent when using a ratio of average change in parameter to average parameter.

4. The method of claim 1 wherein the one or more distribution design criteria comprises an upper threshold of total variance in an average change in value of the at least one cutter parameter for a cutter and its radially trailing cutter.

5. The method of claim 4 wherein the upper threshold of total variance is less than five percent when using a ratio of average change in parameter to average parameter.

6. The method of claim 1 wherein the one or more distribution design criteria comprises an upper threshold of total lateral bit moment imbalance for the fixed cutter bit.

7. The method of claim 1 wherein the one or more distribution design criteria comprises a total lateral bit moment imbalance for the fixed cutter bit of less than four percent of a value of the torque on bit.

8. The method of claim 1 wherein the one or more distribution design criteria comprises a total variance in the average of the values of the at least one cutter parameter for the region of the fixed cutter bit of less than one hundred percent.

9. The method of claim 1 wherein the region of the fixed cutter bit comprises at least one of the face of the fixed cutter bit, the entire fixed cutter bit, an individual blade of the fixed cutter bit, selected blades of the fixed cutter bit, profile segments of the fixed cutter bit, quadrants of the fixed cutter bit, or other spatial divisions of the fixed cutter bit.

10. A method for designing a fixed cutter drill bit, comprising:

defining a cutting structure for the fixed cutter bit and applying the defined cutting structure to a simulated formation for producing generated values of at least one cutter parameter for the defined cutting structure selected from the group consisting of force, torque, work, or power;

determining whether a summation of generated force values of the defined cutting structure produce a net imbalance force for the fixed cutter bit that meets one or more design criteria, and redefining the cutting structure until the one or more net imbalance force design criteria are met; and determining whether the generated values of the at least one cutter parameter meet one or more design criteria for optimizing a distribution of generated values for individual cutters relative to other cutters within a region of the fixed cutter bit, and redefining the cutting structure until the one or more distribution design criteria are met;

wherein the method is implemented utilizing one or more computer programs.

11. The method of claim 10 further comprising:

determining whether the defined cutting structure produces a wear value for the fixed cutter bit that meets one or more design criteria and redefining the cutting structure until the one or more wear value design criteria are met.

12. The method of claim 10 wherein the one or more net imbalance design criteria comprises a total lateral imbalance force of less than four percent of a value of the weight on bit.

13. The method of claim 10 wherein the one or more distribution design criteria comprises a total variance in an average change in value of the at least one cutter parameter for a cutter and its radially trailing and leading cutters of less than five percent when using a ratio of average change in parameter to average parameter.

14. The method of claim 10 wherein the one or more distribution design criteria comprises a total variance in an average change in value of the at least one cutter parameter for a cutter and its radially trailing cutter of less than five percent when using a ratio of average change in parameter to average parameter.

15. The method of claim 10 wherein the one or more distribution design criteria comprises a total lateral bit moment imbalance for the fixed cutter bit of less than four percent of a value of the torque on bit.

16. The method of claim 10 wherein the region of the fixed cutter bit comprises at least one of the face of the fixed cutter bit, the entire fixed cutter bit, an individual blade of the fixed cutter bit, selected blades of the fixed cutter bit, profile segments of the fixed cutter bit, quadrants of the fixed cutter bit, or other spatial divisions of the fixed cutter bit.

17. The method of claim 10 wherein the at least one cutter parameter of force comprises one or more of axial force or drag force.

18. A fixed cutter drill bit designed by:

defining a cutting structure for the fixed cutter bit and applying the defined cutting structure to a simulated formation for producing generated values of at least one cutter parameter for the defined cutting structure selected from the group consisting of force, torque, work, or power;

determining whether the generated values of the at least one cutter parameter meet one or more design criteria for optimizing a distribution of generated values for individual cutters relative to other cutters within a region of the fixed cutter bit; and redefining the cutting structure until the one or more distribution design criteria are met.

19. A drilling system, comprising:

a drill string which is connected to a fixed cutter bit; and a rotary drive configured to rotate at least part of the drill string together with the fixed cutter bit; and wherein the fixed cutter bit is designed by:

defining a cutting structure for the fixed cutter bit and applying the defined cutting structure to a simulated formation for producing generated values of at least one cutter parameter for the defined cutting structure selected from the group consisting of force, torque, work, or power;

determining whether the generated values of the at least one cutter parameter meet one or more design criteria for optimizing a distribution of generated values for individual cutters relative to other cutters within a region of the fixed cutter bit; and redefining the cutting structure until the one or more distribution design criteria are met.

* * * * *